US011022267B2

(12) United States Patent
Uchida et al.

(10) Patent No.: US 11,022,267 B2
(45) Date of Patent: Jun. 1, 2021

(54) VEHICLE LAMP

(71) Applicant: KOITO MANUFACTURING CO., LTD., Tokyo (JP)

(72) Inventors: Naoki Uchida, Shizuoka (JP); Honami Fujii, Shizuoka (JP); Masanori Kito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/772,620

(22) PCT Filed: Dec. 7, 2018

(86) PCT No.: PCT/JP2018/045147
§ 371 (c)(1),
(2) Date: Jun. 12, 2020

(87) PCT Pub. No.: WO2019/117042
PCT Pub. Date: Jun. 20, 2019

(65) Prior Publication Data

US 2020/0386383 A1 Dec. 10, 2020

(30) Foreign Application Priority Data

Dec. 13, 2017 (JP) ..... JP2017-239076
Dec. 13, 2017 (JP) ..... JP2017-239077

(51) Int. Cl.
*F21S 41/63* (2018.01)
*F21S 41/16* (2018.01)
(Continued)

(52) U.S. Cl.
CPC ..... *F21S 41/635* (2018.01); *F21S 41/125* (2018.01); *F21S 41/16* (2018.01); *F21S 41/255* (2018.01); *F21Y 2115/30* (2016.08)

(58) Field of Classification Search
CPC ..... F21S 41/635; F21S 41/16; F21S 41/255; F21Y 2115/30
See application file for complete search history.

(56) References Cited

U.S. PATENT DOCUMENTS 4,751,706 A * 6/1988 Rohde ..... H01S 3/07 372/102
5,859,715 A * 1/1999 Meyers ..... G02B 26/106 359/17

(Continued)

FOREIGN PATENT DOCUMENTS

JP 10-232592 A 9/1998
JP 2008-045870 A 2/2008

(Continued)

OTHER PUBLICATIONS

International Search Report for PCT/JP2018/045147 dated Feb. 26, 2019 (PCT/ISA/210).

*Primary Examiner* — Evan P Dzierzynski
(74) *Attorney, Agent, or Firm* — Sughrue Mion, PLLC

(57) ABSTRACT

A vehicle lamp (1) includes a light source (30) that emits pieces of laser light (LR, LG, LB) having different wavelengths in a time division manner, and a plurality of diffraction gratings (43R, 43G, 43B) corresponding to the pieces of laser light (LR, LG, LB) of the wavelengths, respectively. The laser light (LR, LG, LB) of the wavelengths emitted from the light source (30) are incident on the diffraction gratings (43R, 43G, 43B) corresponding to the laser light (LR, LG, LB), and regions irradiated with light (DLR, DLG, DLB) emitted from the diffraction grating (43R, 43G, 43B) overlap with each other.

7 Claims, 8 Drawing Sheets

(51) Int. Cl.

| | |
|---|---|
| ***F21S 41/125*** | (2018.01) |
| ***F21S 41/255*** | (2018.01) |
| *F21Y 115/30* | (2016.01) |

(56) References Cited

U.S. PATENT DOCUMENTS

| | | | | |
|---|---|---|---|---|
| 2016/0093269 | A1* | 3/2016 | Buckley | G09F 9/30 345/501 |
| 2017/0146896 | A1 | 5/2017 | Hirata et al. | |
| 2017/0334341 | A1 | 11/2017 | Kurashige et al. | |
| 2018/0142840 | A1* | 5/2018 | Kurashige | G02B 26/12 |
| 2020/0032976 | A1* | 1/2020 | Shimada | F21S 41/176 |

FOREIGN PATENT DOCUMENTS

| | | | |
|---|---|---|---|
| JP | 2012-146621 | A | 8/2012 |
| JP | 2015-132707 | A | 7/2015 |
| JP | 2016-135629 | A | 7/2016 |
| WO | 2015/151283 | A1 | 10/2015 |
| WO | 2016/072505 | A | 5/2016 |

* cited by examiner

VEHICLE LAMP

CROSS REFERENCE TO RELATED APPLICATIONS

This application is a National Stage of International Application No. PCT/JP2018/045147 filed Dec. 7, 2018, claiming priority based on Japanese Patent Application No. 2017-239076, filed Dec. 13, 2017 and Japanese Patent Application No. 2017-239077, filed Dec. 13, 2017.

TECHNICAL FIELD

The present invention relates to a vehicle lamp, and more particularly to a vehicle lamp including a diffraction grating.

BACKGROUND ART

As a vehicle lamp, a vehicle headlight represented by an automobile headlight, a drawing device for drawing an image on a road surface, and the like are known. By the way, various configurations have been studied in order to make the light distribution pattern in the vehicle lamp a predetermined light distribution pattern, and for example, Patent Literature 1 below discloses that a predetermined light distribution pattern is formed using a hologram element which is a kind of diffraction grating.

Furthermore, Patent Literature 2 below discloses a laser drawing device including: a laser head that applies laser light; a drive mechanism that includes a gear that adjusts an irradiation angle of the laser head, a drive motor, and the like; and a control unit, a laser drawing device attached to a vehicle. In the laser drawing device of Patent Literature 2, the control unit controls the irradiation angle of the laser light emitted from the laser head on the basis of a control signal input from an electronic control unit (ECU) of the vehicle, so that a mark of a predetermined shape is drawn on the road surface. In the laser drawing device of Patent Literature 2, since the information about the shape of the mark drawn on the road surface is stored in the ECU, the shape of the mark drawn on the road surface can be changed by changing the information about the shape of the mark.

[Patent Literature 1] JP 2012-146621 A

[Patent Literature 2] JP 2008-45870 A

SUMMARY OF INVENTION

A vehicle lamp of the present invention includes: a light source that emits a plurality of pieces of laser light having different wavelengths in a time division manner; and a plurality of diffraction gratings that correspond to the pieces of laser light of wavelengths, respectively, in which the pieces of laser light of the wavelengths emitted from the light source are incident on the diffraction gratings corresponding to the pieces of laser light, respectively, and regions irradiated with pieces of light emitted from the diffraction gratings overlap with each other.

In the vehicle lamp of the present invention, a plurality of pieces of laser light having different wavelengths emitted from the light source in a time division manner are diffracted by the diffraction gratings corresponding to the pieces of laser light of the wavelengths, respectively, and emitted from the diffraction gratings, and the regions irradiated with the pieces of light emitted from the diffraction gratings, respectively overlap with each other. Therefore, regions irradiated with light are sequentially irradiated with pieces of light having different wavelengths. By the way, when pieces of light having different wavelengths, that is, pieces of light of different colors are repeatedly applied in a cycle shorter than the time resolution of human vision, a human may recognize that light obtained by synthesizing the pieces of light of different colors is applied by the afterimage phenomenon. Therefore, when a plurality of pieces of laser light having different wavelengths are repeatedly emitted in a cycle shorter than the time resolution of human vision, light obtained by synthesizing pieces of laser light emitted from the light source can be applied by the afterimage phenomenon. In this way, the color balance of the light obtained by synthesizing by the afterimage phenomenon can be adjusted by adjusting the intensity of each piece of laser light emitted from the light source and the length of the emission time of each piece of laser light. Therefore, the vehicle lamp of the present invention enables adjustment of the color balance without measures such as replacement of the light source. Note that the adjustment of the color balance includes an adjustment when manufacturing the vehicle lamp as well as an adjustment when using the vehicle lamp.

By the way, since the diffraction grating has wavelength dependence, pieces of light having different wavelengths tend to have different light distribution patterns due to the diffraction grating. However, in the vehicle lamp of the present invention, the plurality of pieces of laser light having different wavelengths are diffracted by the diffraction gratings corresponding to the pieces of laser light of wavelengths, respectively, as described above. For this reason, it is easy to make regions irradiated with pieces of light emitted from respective diffraction gratings overlap with each other, and it is easy to form a desired light distribution pattern by the afterimage phenomenon.

Furthermore, it is preferable that at least some of the outer shapes of the regions irradiated with the pieces of light emitted from respective diffraction gratings match.

With such a configuration, it is possible to suppress the occurrence of color bleeding near the edges of the light distribution pattern formed by the afterimage phenomenon.

Furthermore, it is preferable that the light source emits at least three pieces of laser light having different wavelengths.

In this case, pieces of laser light of three primary colors can be used. Therefore, by adjusting the intensity of each piece of laser light emitted from the light source, light of a desired color can be applied by the afterimage phenomenon.

Furthermore, a support member that supports the plurality of diffraction gratings and rotates may be further provided, the plurality of diffraction gratings may be arranged on a circumference of a circle centering on a rotation axis of the support member, and emission of the plurality of pieces of laser light in a time division manner and rotation of the support member may be synchronized with each other.

With such a configuration, it is possible to cause a plurality of pieces of laser light having different wavelengths to be incident on the diffraction gratings corresponding to respective pieces of laser light of wavelengths without adjusting the irradiation angle of the laser light emitted from the light source. Generally, the drive mechanism for adjusting the irradiation angle of laser light tends to be complicated. Therefore, as compared to the case where the drive mechanism for adjusting the irradiation angle of the laser light emitted from the light source is provided, the configuration can be simplified.

Furthermore, a support member that supports the plurality of diffraction gratings and reciprocates may be further provided, the plurality of diffraction gratings may be arranged on a straight line parallel to a reciprocating direction of the support member, and emission of the plurality of pieces of laser light in a time division manner and reciprocating of the support member may be synchronized with each other.

With such a configuration, it is possible to cause a plurality of pieces of laser light having different wavelengths to be incident on the diffraction gratings corresponding to respective pieces of laser light of wavelengths without adjusting the irradiation angle of the laser light emitted from the light source. Therefore, as compared to the case where the drive mechanism for adjusting the irradiation angle of the laser light emitted from the light source is provided, the configuration can be simplified.

Furthermore, an optical path changing element for guiding the pieces of laser light of the wavelengths emitted from the light source to the diffraction gratings corresponding to respective pieces of laser light may be further provided.

With this configuration, the degree of freedom in the positional relationship between the light source and the plurality of diffraction gratings is improved and the size can be reduced as compared to the case where the optical path changing element is not provided. Furthermore, it is possible to cause the plurality of pieces of laser light having different wavelengths to be incident on the diffraction gratings corresponding to respective pieces of laser light of wavelengths without adjusting the irradiation angle of the laser light emitted from the light source. Therefore, as compared to the case where the drive mechanism for adjusting the irradiation angle of the laser light emitted from the light source is provided, the configuration can be simplified.

The vehicle lamp of the present invention includes: a light source; a plurality of light distribution pattern forming units; and a support member that supports the plurality of light distribution pattern forming units and rotates, in which each of the light distribution pattern forming units includes at least one diffraction grating that is arranged on a circumference centering on a rotation axis of the support member, and emits light of a predetermined light distribution pattern upon incidence of laser light emitted from the light source, and light distribution patterns of the light emitted from the diffraction gratings of at least two of the light distribution pattern forming units are different from each other.

In this vehicle lamp, the laser light emitted from the light source is incident on the diffraction grating of the light distribution pattern forming unit, and the light of a predetermined light distribution pattern is emitted from this diffraction grating. Therefore, it is possible to draw an image on an irradiation target object such as a road surface without adjusting the irradiation angle of the laser light emitted from the light source, and as compared to a vehicle lamp that draws an image on a road surface or the like by adjusting the irradiation angle of the light emitted from the light source as in Patent Literature 2 above, an image can be drawn on the road surface or the like with a simple configuration. By the way, in a case where each of the light distribution pattern forming units includes a plurality of diffraction gratings that emit light of a predetermined light distribution pattern upon incidence of laser light emitted from the light source, for example, by incidence of the light from the light source simultaneously to these diffraction gratings, pieces of light emitted from these diffraction gratings can be applied to the irradiation target object such as the road surface so that the pieces of light overlap with each other, and a predetermined image can be drawn. Note that, when the light distribution pattern forming unit includes one diffraction grating, the diffraction grating is the light distribution pattern forming unit.

Furthermore, in this vehicle lamp, the diffraction gratings of the respective light distribution pattern forming units are arranged on the circumference centering on the rotation axis of the support member. Therefore, by rotating the support member by a predetermined angle, the diffraction grating on which the laser light emitted from the light source is incident can be changed to the diffraction grating of another light distribution pattern forming unit. Furthermore, the light distribution patterns of the light emitted from the diffraction gratings of at least two light distribution pattern forming units are different from each other. Therefore, by rotating the support member by a predetermined angle, the image drawn on the road surface or the like can be switched. Furthermore, a moving image can be drawn on a road surface or the like by continuously rotating the support member and continuously switching the images. By the way, generally, when a component is rotationally moved, an operating noise tends to be less likely to be generated than when a component is reciprocally moved. Therefore, it is possible to suppress the operating noise when switching the image drawn on the road surface or the like, as compared to the case of switching the image drawn on the road surface or the like by reciprocating the support member.

Furthermore, in the case of including a plurality of light distribution pattern forming units, it is preferable that the light source emits the plurality of pieces of laser light having different wavelengths in a time division manner, emission of the plurality of pieces of laser light in a time division manner and rotation of the support member are synchronized with each other, each of the light distribution pattern forming units includes at least one set including the plurality of diffraction gratings corresponding to the pieces of laser light of the wavelengths, and in each of the light distribution pattern forming units, the pieces of laser light of the wavelengths emitted from the light source are incident on the diffraction gratings corresponding to the pieces of laser light.

In this case, in each of the light distribution pattern forming units, the plurality of pieces of laser light having different wavelengths emitted from the light source in a time division manner are diffracted by the diffraction gratings corresponding to the pieces of laser light of the wavelengths, respectively, and emitted from the diffraction gratings. Therefore, pieces of light having different wavelengths are sequentially emitted from the light distribution pattern forming units, respectively, and these pieces of light are sequentially applied to an irradiation target object such as a road surface. As described above, when pieces of light having different wavelengths, that is, pieces of light of different colors are repeatedly applied in a cycle shorter than the time resolution of human vision, a human may recognize that light obtained by synthesizing pieces of light of different colors are applied by the afterimage phenomenon. Therefore, for example, when a plurality of pieces of laser light having different wavelengths are repeatedly emitted in a cycle shorter than the time resolution of human vision, each of the light distribution pattern forming units can apply light in obtained by synthesizing pieces of laser light emitted from the light source by the afterimage phenomenon to draw an image on a road surface or the like. In this way, the color balance of the image drawn by the afterimage phenomenon can be adjusted by adjusting the intensity of each piece of laser light emitted from the light source and the emission time length of each piece of laser light. Therefore, with this vehicle lamp, the color balance of the image to be drawn can be adjusted. Note that the adjustment of the color balance includes an adjustment when using the vehicle lamp and an adjustment when manufacturing the vehicle lamp.

As described above, since the diffraction grating has wavelength dependence, pieces of light having different wavelengths tend to have different light distribution patterns due to the diffraction grating. However, in this vehicle lamp, as described above, in each of the light distribution pattern forming units, a plurality of pieces of laser light having different wavelengths are diffracted by the diffraction gratings corresponding to respective pieces of laser light of wavelengths. For this reason, it is easy to make regions irradiated with pieces of light emitted from the plurality of diffraction gratings overlap with each other, and it is easy to draw a desired image by the afterimage phenomenon.

Furthermore, when a plurality of light distribution pattern forming units are provided and the light source emits a plurality of pieces of the laser light having different wavelengths in a time division manner, it is preferable that at least some of the outer shape of the region irradiated with the light emitted from the plurality of diffraction gratings match.

With such a configuration, it is possible to suppress the occurrence of color bleeding near the edges of the image drawn by the afterimage phenomenon.

Furthermore, in a case where a plurality of light distribution pattern forming units are provided and the light source emits a plurality of pieces of the laser light having different wavelengths in a time division manner, it is preferable that the light source emits at least three pieces of laser light having different wavelengths.

In this case, pieces of laser light of three primary colors can be used. Therefore, by adjusting the intensity of each piece of laser light emitted from the light source, light of a desired color can be applied by the afterimage phenomenon, and an image of a desired color can be drawn on the road surface or the like.

DESCRIPTION OF EMBODIMENTS

Hereinafter, embodiments for implementing a vehicle lamp according to the present invention will be exemplified with reference to the accompanying drawings. The embodiments exemplified below are for the purpose of facilitating the understanding of the present invention, and are not intended to limit the present invention. The present invention can be modified and improved from the following embodiments without departing from the gist thereof.

First Embodiment

Figure 1:
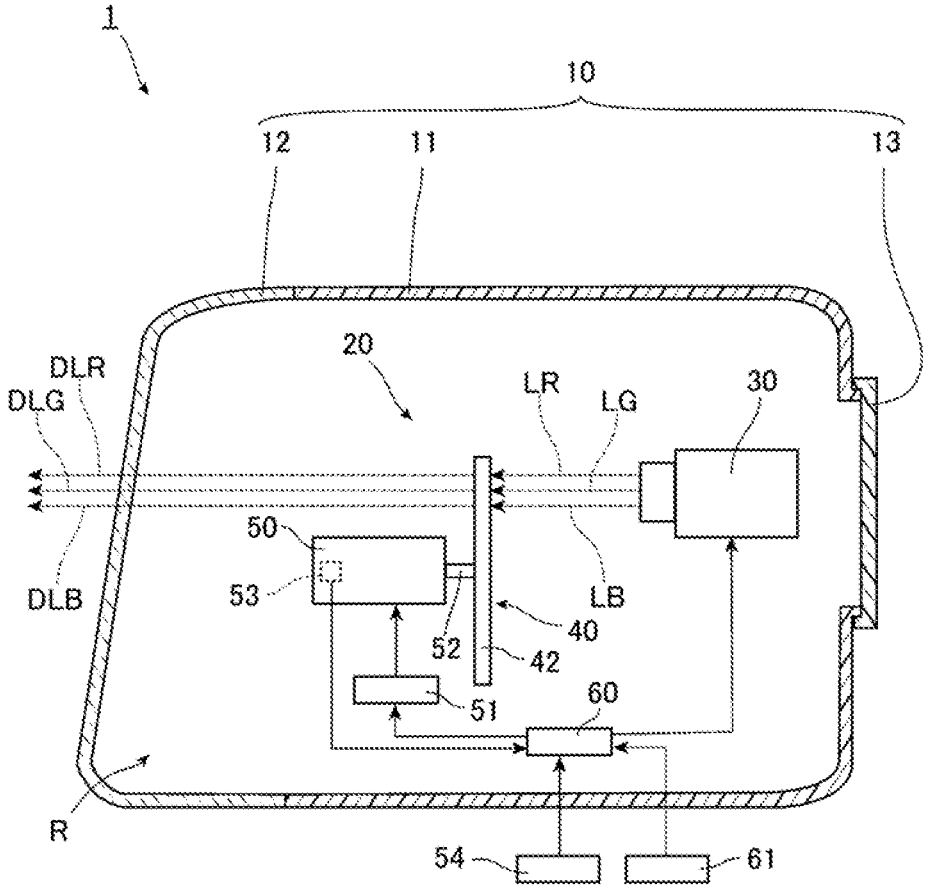
FIG. 1 is a diagram showing an example of a vehicle lamp according to a first embodiment of the present invention.

FIG. 1 is a diagram showing an example of a vehicle lamp according to the present embodiment, and is a diagram schematically showing a vertical cross section of the vehicle lamp. In the present embodiment, a vehicle lamp 1 is a vehicle headlamp, and as shown in FIG. 1, the vehicle lamp 1 of the present embodiment includes a housing 10 and a lamp unit 20 as main components.

The housing 10 includes a lamp housing 11, a front cover 12, and a back cover 13 as main components. The front of the lamp housing 11 is open, and the front cover is fixed to the lamp housing 11 so as to close the opening. An opening smaller than that in the front is formed in the rear of the lamp housing 11, and the back cover 13 is fixed to the lamp housing 11 so as to close the opening.

A space formed by the lamp housing 11, the front cover 12 closing the front opening of the lamp housing 11, and a back cover 13 closing the rear opening of the lamp housing 11 is a lamp room R. The lamp unit 20 is housed in the lamp room R.

The lamp unit 20 of the present embodiment includes a light source 30, a diffraction grating unit 40, a motor 50, a motor driver 51, a control unit 60, and an input unit 61 as main components. Note that the lamp unit 20 is fixed to the housing 10 by a configuration (not shown).

The light source 30 of the present embodiment emits a plurality of pieces of laser light having different wavelengths in a time division manner. The light source 30 of the present embodiment has a collimator lens (not shown) that collimates the fast axis direction and the slow axis direction of the transmitted laser light, and the light source 30 emits the laser light that has passed through the collimator lens. The light source 30 includes a light emitting element (not shown) that emits red laser light LR having a power peak wavelength of, for example, 638 nm, a light emitting element (not shown) that emits green laser light LG having a power peak wavelength of, for example, 515 nm, a light emitting element (not shown) that emits blue laser light LB having a power peak wavelength of, for example, 445 nm, and a drive circuit (not shown). Electric power is supplied to these light emitting elements via the drive circuit. Such a light source 30 can emit the red laser light LR, the green laser light LG, and the blue laser light LB in a time division manner by adjusting the electric power supplied to each light emitting element, and the pieces of laser light emitted from the light source 30 are emitted to approximately the same region. That is, the light source 30 of the present embodiment is configured to switch among the red laser light LR, the green laser light LG, and the blue laser light LB so that the laser light LR, LG, LB of any color can be emitted at a desired timing for a desired time. Furthermore, the light source 30 can adjust the intensity of the emitted laser light LR, LG, LB by adjusting the electric power supplied to each light emitting element. In the present embodiment, the intensity of the laser light LR, LG, LB is adjusted so that the color of the light obtained by synthesizing the laser light LR, LG, LB is white in the initial state. As the light source 30, for example, a semiconductor laser or the like in which a light emitting element is a laser element that emits laser light can be used.

The motor 50 of the present embodiment is an electric motor having an encoder 53 that detects the rotation position of an output shaft 52, and a support member 42 of the diffraction grating unit 40 is fixed to the output shaft 52. A motor driver 51 is electrically connected to the motor 50, electric power is supplied to the motor 50 via the motor driver 51, and the output shaft 52 rotates according to the electric power supplied from the motor driver 51. As the motor 50, for example, a stepping motor, an alternating current (AC) servo motor, or the like can be used, and as the encoder 53, for example, a rotary absolute encoder or the like can be used.

Figure 2:
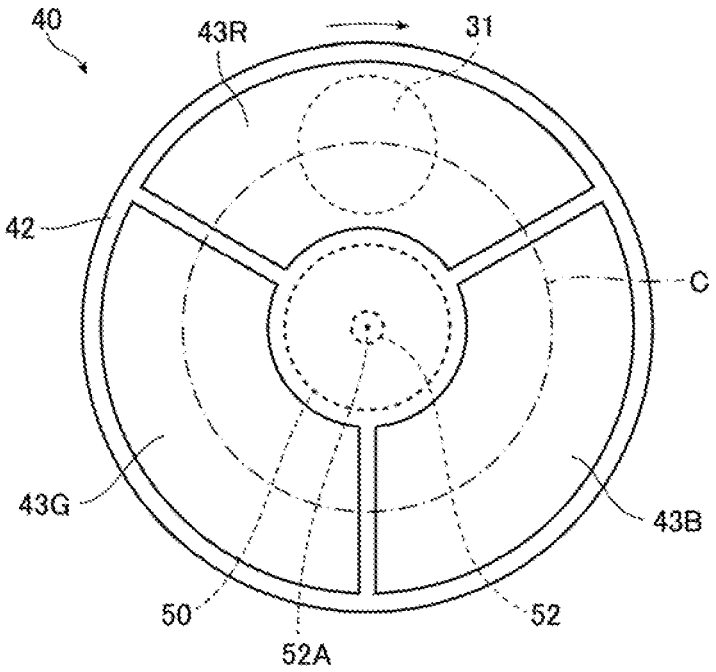
FIG. 2 is a front view schematically showing a diffraction grating unit.

FIG. 2 is a front view schematically showing the diffraction grating unit 40 shown in FIG. 1. The diffraction grating unit 40 of the present embodiment includes three diffraction gratings 43R, 43G, 43B and a support member 42 as main components, and the laser light emitted from the light source 30 is incident on the diffraction grating unit 40. Note that, in FIG. 2, a region 31 on which the laser light LR, LG, LB emitted from the light source 30 is incident is shown by a broken line.

The support member 42 of the present embodiment is a plate-shaped member having an approximately circular outer shape in a front view, one end of the output shaft 52 of the motor 50 is fixed to the center of the support member 42, and the support member 42 can rotate by the motor 50 with a rotation axis 52A of the output shaft 52 as a rotation axis. The rotation axis 52A extends in the direction perpendicular to the paper surface in FIG. 2. The support member 42 of the present embodiment is formed with three through holes penetrating in the plate thickness direction of the support member 42, the three diffraction gratings 43R, 43G, 43B are fitted into the through holes, respectively, and the three diffraction gratings 43R, 43G, 43B are fixed to the support member 42. Therefore, when the support member 42 rotates about the rotation axis 52A of the output shaft 52 as a rotation axis, the diffraction gratings 43R, 43G, 43B rotate about the rotation axis 52A. The three diffraction gratings 43R, 43G, 43B supported by the support member 42 as described above are arranged on the circumference of a circle C centering on the rotation axis 52A when viewed from the rotation axis 52A of the output shaft 52. The circumference of this circle C crosses the region 31 on which the laser light emitted from the light source 30 is incident. Therefore, by rotation of the support member 42 to a predetermined rotation position with respect to each of the diffraction gratings 43R, 43G, 43B, the diffraction gratings 43R, 43G, 43B and the region 31 on which the laser light emitted from the light source is incident overlap, and the laser light LR, LG, LB emitted from the light source 30 can be incident on the diffraction gratings 43R, 43G, 43B. In the present embodiment, the diffraction gratings 43R, 43G, 43B are arranged at approximately equal intervals along the entire circumference of the circle C and are located so as to be rotationally symmetric with respect to the rotation axis 52A.

In the present embodiment, the diffraction gratings 43R, 43G, 43B are transmissive diffraction gratings, diffract the light incident from one surface, and emit the diffracted light from the other surface. Each of the diffraction gratings 43R, 43G, 43B of the present embodiment has a diffraction grating pattern (not shown) in each of grating regions (not shown) formed by being divided in the radial direction and the circumferential direction of a circle C centering on the rotation axis 52A. The grating regions are formed so that when the diffraction gratings 43R, 43G, 43B and the region 31 on which the laser light emitted from the light source 30 is incident overlap, one or more of the grating regions are located in this region 31.

In the present embodiment, the diffraction grating 43R corresponds to the red laser light LR emitted from the light source 30, and the red laser light LR is incident on the diffraction grating 43R and is diffracted. Furthermore, the diffraction grating 43G corresponds to the green laser light LG emitted from the light source 30, and the green laser light LG is incident on the diffraction grating 43G and is diffracted. Furthermore, the diffraction grating 43B corresponds to the blue laser light LB emitted from the light source 30, and the blue laser light LB is incident on the diffraction grating 43B and is diffracted.

Light DLR obtained by the red laser light LR diffracted by the diffraction grating 43R and emitted from the diffraction grating 43R is red, and light DLG obtained by the green laser light LG diffracted by the diffraction grating 43G and emitted from the diffraction grating 43G is green, and light DLB obtained by the blue laser light LB diffracted by the diffraction grating 43B and emitted from the diffraction grating 43B is blue. The pieces of light DLR, DLG, DLB are emitted from the diffraction gratings 43R, 43G, 43B, respectively, so that the irradiated regions overlap with each other. In other words, the diffraction gratings 43R, 43G, 43B emit light DLR, DLG, DLB, respectively, so that the light distribution pattern of the light DLR emitted from the diffraction grating 43R, the light distribution pattern of the light DLG emitted from the diffraction grating 43G, and the light distribution pattern of the light DLB emitted from the diffraction grating 43B overlap with each other. Note that, as described above, the diffraction gratings 43R, 43G, 43B have a diffraction grating pattern in each of the divided plurality of grating regions, and diffract the pieces of incident laser light LR, LG LB, respectively, so that each diffraction grating pattern has such a light distribution pattern. That is, the diffraction gratings 43R, 43G, 43B compose a set of a plurality of diffraction gratings having the same diffraction grating pattern.

Specifically, the diffraction gratings 43R, 43G, 43B diffract the red laser light LR, the green laser light LG, and the blue laser light LB emitted from the light source 30, respectively, so that the light obtained by synthesizing the light DLR, DLG, DLB emitted from the diffraction gratings 43R, 43G, 43B, respectively, has a low beam light distribution pattern. An intensity distribution is also included in each of the light distribution patterns. Therefore, the diffraction gratings 43R, 43G, 43B of the present embodiment diffract the red laser light LR, the green laser light LG, and the blue laser light LB that are emitted from the light source 30 and incident on the diffraction gratings 43R, 43G, 43B so that each of the pieces of light DLR, DLG, DLB emitted from respective diffraction gratings 43R, 43G, 43B overlaps the low beam light distribution pattern, and has the intensity distribution based on the intensity distribution of the low beam light distribution pattern. Thus, the red component light DLR of the low beam light distribution pattern is emitted from the diffraction grating 43R, the green component light DLG of the low beam light distribution pattern is emitted from the diffraction grating 43G, and the blue component light DLB of the low beam light distribution pattern is emitted from the diffraction grating 43B.

Note that the intensity distribution based on the intensity distribution of the low beam light distribution pattern described above means that the intensity of each piece of light emitted from the diffraction gratings 43R, 43G, 43B is high in the portion where the intensity in the low beam light distribution pattern is high.

The input unit 61 of the present embodiment outputs information of commands, set values or the like that are input according to an operation by the user, as an electric signal. In the present embodiment, the information input to the input unit 61 includes the intensity of each piece of the laser light LR, LG, LB emitted from the light source 30 and the length of emission time of each piece of the laser light LR, LG, LB. Examples of the input unit 61 include a switch group in which a plurality of rotary switches are mounted on a circuit board.

The control unit 60 of the present embodiment is electrically connected to a control device 54 such as a vehicle electronic control unit (ECU), the light source 30, the motor driver 51, the encoder 53 of the motor 50, and the input unit 61. The control unit 60 controls the emission state of the laser light of the light source 30 and the rotation state of the output shaft 52 of the motor 50. The control unit 60 performs this control on the basis of a signal input from the vehicle control device 54 to the control unit 60, a signal input from the encoder 53 of the motor 50 to the control unit 60, and a signal input from the input unit 61 to the control unit 60.

Next, the emission of light by the vehicle lamp 1 will be described.

The above-mentioned control unit 60 detects, for example, a signal indicating the irradiation of the low beam from the vehicle control device 54, and, in the case of the input state where the signal indicating the irradiation of the low beam is input to the control unit 60, controls the emission state of the laser light of the light source 30 and the rotation state of the output shaft 52 of the motor 50 to cause the vehicle lamp 1 to emit light.

Specifically, the control unit 60 of the present embodiment drives the above-mentioned motor driver 51, adjusts the voltage applied to the motor 50, and rotates the output shaft 52 of the motor 50. Since the support member 42 is fixed to the output shaft 52 as described above, the rotation of the output shaft 52 causes the support member 42 and the diffraction gratings 43R, 43G, 43B (diffraction grating unit 40) to rotate about the rotation axis 52A of the output shaft 52. At this time, the control unit 60 drives the motor driver 51 on the basis of the signal input from the encoder 53 of the motor 50 to the control unit 60. Note that, in the present embodiment, the diffraction grating unit 40 is rotated clockwise in FIG. 2.

As described above, the encoder 53 can detect the rotation position of the output shaft 52, and the position of the above-mentioned region 31 on which the laser light emitted from the light source 30 is incident hardly changes even when the diffraction grating unit 40 rotates. Therefore, the control unit 60 can detect which position in the diffraction grating unit 40 overlaps the region 31 on the basis of the signal input from the encoder 53 to the control unit 60. Such a control unit 60 drives the motor driver 51 to rotate the diffraction grating unit 40 to the position where the diffraction grating 43R corresponding to the red laser light LR overlaps the entire region 31, for example, the position where the center of the diffraction grating 43R in the rotation direction of the diffraction grating unit 40 matches the center of the region 31.

Next, when the center of the diffraction grating 43R in the rotation direction of the diffraction grating unit 40 matches the center of the region 31, the control unit 60 drives the drive circuit of the light source 30 to cause the light source 30 to emit the red laser light LR for a predetermined time. The red laser light LR emitted from the light source 30 is incident on the diffraction grating 43R and is diffracted by the diffraction grating 43R as described above, and the red component light DLR of the low beam light distribution pattern is emitted from the diffraction grating 43R for a predetermined time. The red component light DLR of the low beam light distribution pattern is emitted from the vehicle lamp 1 through the front cover 12 for a predetermined time.

Next, the control unit 60 drives the motor driver 51 to rotate the diffraction grating unit 40 to the position where the diffraction grating 43G corresponding to the green laser light LG overlaps the entire region 31, for example, the position where the center of the diffraction grating 43G in the rotation direction of the diffraction grating unit 40 matches the center of the region 31. Next, when the center of the diffraction grating 43G in the rotation direction of the diffraction grating unit 40 matches the center of the region 31, the control unit 60 causes the light source 30 to emit the green laser light LG for a predetermined time. In the present embodiment, the emission time length of the green laser light LG is approximately the same as the emission time length of the red laser light LR. The green laser light LG emitted from the light source 30 is incident on the diffraction grating 43G and is diffracted by the diffraction grating 43G as described above, and the green component light DLG of the low beam light distribution pattern is emitted from the diffraction grating 43G for a predetermined time. The green component light DLG of the low beam light distribution pattern is emitted from the vehicle lamp 1 through the front cover 12 for a predetermined time.

Next, the control unit 60 drives the motor driver 51 to rotate the diffraction grating unit 40 to the position where the diffraction grating 43B corresponding to the blue laser light LB overlaps the entire region 31, for example, the position where the center of the diffraction grating 43B in the rotation direction of the diffraction grating unit 40 matches the center of the region 31. Next, when the center of the diffraction grating 43B in the rotation direction of the diffraction grating unit 40 matches the center of the region 31, the control unit 60 causes the light source 30 to emit the blue laser light LB for a predetermined time. In the present embodiment, the emission time length of the blue laser light LB is approximately the same as the emission time length of the red laser light LR described above. The blue laser light LB emitted from the light source 30 is incident on the diffraction grating 43B and is diffracted by the diffraction grating 43B as described above, and the blue component light DLB of the low beam light distribution pattern is emitted from the diffraction grating 43B for a predetermined time. The blue component light DLB of the low beam light distribution pattern is emitted from the vehicle lamp 1 through the front cover 12 for a predetermined time.

The control unit 60 controls the emission state of the laser light of the light source 30 and the rotation state of the output shaft 52 of the motor 50 so that the rotation of the diffraction grating unit 40, the emission of the red laser light LR from the light source 30, the rotation of the diffraction grating unit 40, the emission of the green laser light LG from the light source 30, the rotation of the diffraction grating unit 40, and the emission of the blue laser light LB from the light source 30 are sequentially repeated. That is, the emission of the red laser light LR, the green laser light LG, and the blue laser light LB of the light source 30 in a time division manner and the rotation of the diffraction grating unit 40 are synchronized with each other. Then, from the vehicle lamp 1, the red component light DLR of the low beam light distribution pattern, the green component light DLG of the low beam light distribution pattern, and the blue component light DLB of the low beam light distribution pattern are sequentially and repeatedly emitted. In the present embodiment, the emission time lengths of the laser light LR, LG, LB are approximately the same, and thus the emission time lengths of the light DLR, DLG, DLB are also approximately the same.

By the way, when pieces of light of different colors are repeatedly applied in a cycle shorter than the time resolution of human vision, a human may recognize that light obtained by synthesizing light of different colors is applied by the afterimage phenomenon. In the present embodiment, when the time from emitting the laser light of a predetermined color to emitting the laser light of the predetermined color again is shorter than the time resolution of human vision, the pieces of light DLR, DLG, DLB emitted from the diffraction gratings 43R, 43G, 43B are repeatedly applied in a shorter cycle than the time resolution of human vision, and the red light DLR, the green light DLG, and the blue light DLB are synthesized by the afterimage phenomenon. The emission time lengths of the light DLR, DLG, DLB are approximately the same. Furthermore, as described above, in the initial state, the intensities of the laser light LR, LG, LB are adjusted so that the color of the light obtained by synthesizing the laser light LR, LG, LB is white. Therefore, the color of the light obtained by synthesizing by the afterimage phenomenon is white. At this time, since each piece of the light DLR, DLG, DLB is made to have an intensity distribution that is based on the intensity distribution of the low beam light distribution pattern while overlapping with the low beam light distribution pattern as described above, the light distribution patterns of the light obtained by synthesizing the light DLR, DLG, DLB by the afterimage phenomenon is the low beam light distribution pattern. Note that the cycle of repeatedly emitting the laser light LR, LG, LB described above is preferably 1/15 s or less from the viewpoint of suppressing feeling of the flicker of light obtained by synthesizing by the afterimage phenomenon. The time resolution of human vision is approximately 1/30 s. In the case of a vehicle lamp, it is possible to suppress feeling of the flicker of light when the cycle of light emission is about twice. If this cycle is 1/30 s or less, the time approximately exceeds the time resolution of human vision. Therefore, it is possible to further suppress feeling of the flicker of light. Moreover, if this cycle is 1/60 s or less, it is preferable from the viewpoint that feeling of the flicker of light can be further suppressed.

Note that, it is preferable that the diffraction gratings 43R, 43G, 43B diffract the pieces of laser light LR, LG, LB, and emit the pieces of light DLR, DLG, DLB, respectively, so that at least some of the outer shapes of the regions irradiated with the light DLR, DLG, DLB match, that is, at least some of the outer shapes of the light distribution patterns of the pieces of light DLR, DLG, DLB match. With such a configuration, it is possible to suppress the occurrence of color bleeding near the edges of the light distribution pattern formed by the afterimage phenomenon as described above. Moreover, it is more preferable that all of these outer shapes match, from the viewpoint that color bleeding near the edges of the light distribution pattern can be further suppressed.

Thus, the vehicle lamp 1 can apply light having a low beam light distribution pattern by the afterimage phenomenon.

Figure 3A:
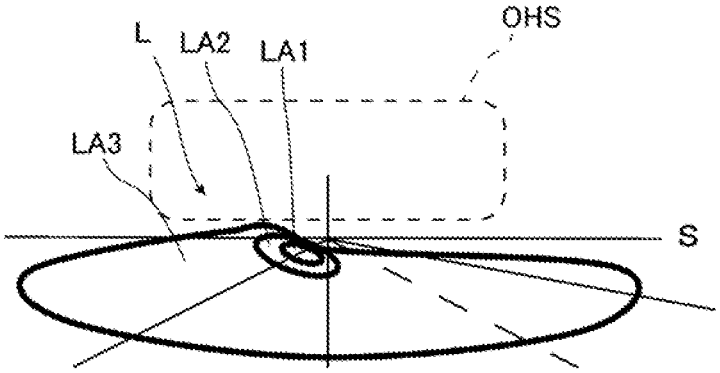
FIG. 3A and FIG. 3B are diagrams showing light distribution patterns.
Figure 3B:
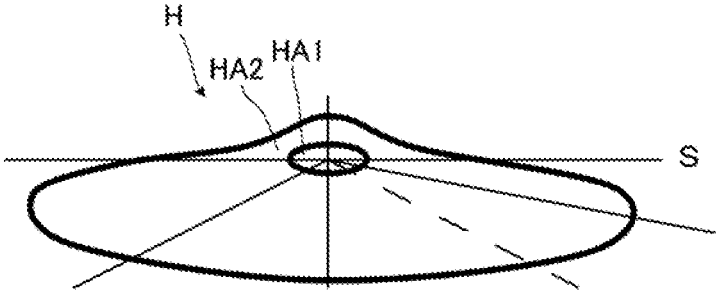

FIG. 3A and FIG. 3B are diagrams showing light distribution patterns for night illumination, specifically, FIG. 3A is the diagram showing a low beam light distribution pattern, and FIG. 3B is the diagram showing a high beam light distribution pattern. In FIG. 3A and FIG. 3B, S indicates a horizontal line, and the light distribution pattern is indicated by a thick line. In the light distribution pattern of the low beam L which is the light distribution pattern for night illumination shown in FIG. 3A, a region LA1 has the highest intensity, and regions LA2 and LA3 have lower intensities in this order. That is, each of the diffraction gratings 43R, 43G, 43B diffracts the light so that the light obtained by synthesizing by the afterimage phenomenon forms a light distribution pattern including the intensity distribution of the low beam L. Note that, as shown by the broken line in FIG. 3A, light having a lower intensity than the low beam may be applied from the vehicle lamp 1 to a part above the position where the low beam L is applied by the afterimage phenomenon. This light is used as sign visual recognition light OHS. In this case, it is preferable that the light distribution patterns of the light DLR, DLG, DLB emitted from the respective diffraction gratings 43R, 43G, 43B include a light distribution pattern overlapping with the region irradiated with the sign visual recognition light OHS, and including the intensity distribution of the sign visual recognition light OHS, and it is more preferable that the light distribution patterns include a light distribution pattern having an outer shape matching with at least some of the outer shape of the region irradiated with the sign visual recognition light OHS, and including the intensity distribution of the sign visual recognition light OHS. Moreover, it is more preferable that this outer shape matches with the entire outer shape of the region irradiated with the sign visual recognition light OHS. In this case, it can be understood that the low beam L and the sign visual recognition light OHS form a light distribution pattern for night illumination. Note that the light distribution pattern for night illumination is not used only at night, but is also used in a dark place such as a tunnel.

Next, adjustment of the color balance of light in the vehicle lamp 1 will be described.

As described above, the input unit 61 is electrically connected to the control unit 60, the intensity of each piece of the laser light LR, LG, LB emitted from the light source 30 and the emission time length of each piece of the laser light LR, LG, LB are input to the control unit 60 from the input unit 61 by electric signals.

In the light obtained by synthesizing by the afterimage phenomenon as described above, the color balance of the light is changed by changing the intensity of the synthesized light or the emission time length of the synthesized light. In the present embodiment, the intensity of each piece of the laser light LR, LG, LB emitted from the light source 30 and the emission time length of each piece of the laser light LR, LG, LB can be adjusted by the input unit 61. Therefore, the color balance of the light to be applied can be adjusted without taking measures such as replacing the light source 30.

Specifically, in the present embodiment, for example, when the intensity of the red laser light LG is set higher than the intensity in the state where the light having the light distribution pattern of the low beam L is applied from the vehicle lamp 1 by the afterimage phenomenon, the color of the white light having the light distribution pattern of the low beam L applied from the vehicle lamp 1 is changed to a color in which red is intensified. Similarly, when the intensity of the green laser light LG is set higher, the color of the white light is changed to a color in which green is intensified, and when the intensity of the blue laser light LG is set higher, the color of the white light is changed to a color in which blue is intensified. On the other hand, when the intensity of the red laser light LR is set lower, the color of the white light is changed to a color in which the blue-green color is intensified, when the intensity of the green laser light LG is set lower, the color of the white light is changed to a color in which the red-purple color is intensified, and when the intensity of the blue laser light LB is set lower, the color of the white light is changed to a color in which yellow is intensified.

Furthermore, in the present embodiment, when the emission time length of the red laser light LG is set longer than the emission time length in the state where the light having the light distribution pattern of the low beam L is applied from the vehicle lamp 1 by the afterimage phenomenon, the color of the white light having the light distribution pattern of the low beam L applied from the vehicle lamp 1 is changed to a color in which red is intensified. Similarly, when the emission time length of the green laser light LG is set longer, the color of the white light is changed to a color in which green is intensified, and when the emission time length of the blue laser light LG is set longer, the color of the white light is changed to a color in which blue is intensified. On the other hand, when the emission time length of the red laser light LR is set shorter, the color of the white light is changed to a color in which the blue-green color is intensified, when the emission time length of the green laser light LG is set shorter, the color of the white light is changed to a color in which the red-purple color is intensified, and when the emission time length of the blue laser light LB is set shorter, the color of the white light is changed to a color in which yellow is intensified.

On the hologram element of the vehicle lamp of Patent Literature 1, white reference light is incident from the light source, and a predetermined light distribution pattern of low beam, high beam or the like is formed by the diffracted light. In the vehicle lamp of Patent Literature 1, the color of the formed predetermined light distribution pattern is white, and the color balance thereof tends to largely depend on the color balance of the reference light applied from the light source. Therefore, in order to adjust the color balance of the formed predetermined light distribution pattern to be formed, it is considered that replacement of the light source or the like is necessary. Therefore, with the vehicle lamp of Patent Literature 1, it is difficult to adjust the color balance of the light to be applied.

Therefore, the vehicle lamp 1 of the present embodiment includes the light source 30 that emits the red laser light LR, the green laser light LG, and the blue laser light LB in a time division manner, the diffraction grating 43R corresponding to the red laser light LR, the diffraction grating 43G corresponding to the green laser light LG, and the diffraction grating 43B corresponding to the blue laser light LB. The pieces of laser light LR, LG, LB emitted from the light source 30 are incident on the diffraction gratings 43R, 43G, 43B corresponding to the laser light LR, LG, LB, respectively, and regions irradiated with light DLR, DLG, DLB emitted from the diffraction gratings 43R, 43G, 43B overlap with each other.

As described above, when pieces of light of different colors are repeatedly applied in a cycle shorter than the time resolution of human vision, a human may recognize that light obtained by synthesizing pieces of light of different colors is applied by the afterimage phenomenon. Therefore, when the red laser light LR, the green laser light LG, and the blue laser light LB are repeatedly emitted in a cycle shorter than the time resolution of human vision, white light obtained by synthesizing the red laser light LR, the green laser light LG, and the blue laser light LB emitted from the light source 30 can be applied by the afterimage phenomenon. Furthermore, the color balance of the light applied by the afterimage phenomenon as described above can be adjusted by adjusting the intensity of each piece of laser light LR, LG, LB emitted from the light source 30 and the emission time length of each piece of laser light LR, LG, LB. Therefore, the vehicle lamp 1 of the present embodiment enables adjustment of the color balance without measures such as replacement of the light source 30.

Since the diffraction gratings 43R, 43G, 43B have wavelength dependence, pieces of light having different wavelengths tend to have different light distribution patterns due to the diffraction gratings 43R, 43G, 43B. However, in the vehicle lamp 1 of the present embodiment, the plurality of pieces of laser light LR, LG, LB having different wavelengths are diffracted by the diffraction gratings 43R, 43G, 43B corresponding to the pieces of laser light having respective wavelengths, respectively, as described above. For this reason, it is easy to make regions irradiated with pieces of light DLR, DLG, DLB emitted from the diffraction gratings 43R, 43G, 43B, respectively, overlap with each other, and it is easy to form a desired light distribution pattern by the afterimage phenomenon.

Furthermore, the light source 30 of the present embodiment emits the red laser light LR, the green laser light LG, and the blue laser light LB having different wavelengths. Therefore, by adjusting the intensity of each piece of laser light LR, LG, LB emitted from the light source 30, light of a desired color can be applied by the afterimage phenomenon.

Furthermore, the vehicle lamp 1 of the present embodiment includes the support member 42 that supports the three diffraction gratings 43R, 43G, 43B and rotates, these diffraction gratings 43R, 43G, 43B are arranged on the circumference of a circle C centering on the rotation axis 52A of the output shaft 52, which is a rotation axis of the support member 42. Emission of the red laser light LR, emission of the green laser light LG, and emission of the blue laser light LB of the light source 30 in a time division manner, and the rotation of the diffraction grating unit 40 (support member 42) are synchronized with each other. With such a configuration, in the vehicle lamp 1, the laser light LR, LG, LB can be incident on the diffraction gratings 43R, 43G, 43B corresponding to the respective laser light LR, LG, LB without adjusting the irradiation angle of the laser light LR, LG, LB emitted from the light source 30. Generally, the drive mechanism for adjusting the irradiation angle of laser light tends to be complicated. Therefore, as compared to the case where the drive mechanism for adjusting the irradiation angle of the laser light emitted from the light source is provided, the configuration can be simplified.

In the vehicle lamp 1 of the present embodiment, the diffraction gratings 43R, 43G, 43B are arranged at approximately equal intervals along the entire circumference of the circle C and are located so as to be rotationally symmetric with respect to the rotation axis 52A. With this configuration, the diffraction grating overlapping the region 31 on which the laser light emitted from the light source 30 is incident can be sequentially changed by sequentially rotating the support member 42 by a predetermined angle. Therefore, as compared to the case where a plurality of diffraction gratings are not arranged at approximately equal intervals on the entire circumference, the control of the rotation state of the output shaft 52 of the motor 50 by the control unit 60 can be simplified, and synchronization of emission of the red laser light LR, the green laser light LG, and the blue laser light LB of the light source 30 in a time division manner, and the rotation of the diffraction grating unit 40 (support member 42) can be facilitated.

Second Embodiment

Next, a second embodiment of the present invention will be described in detail with reference to FIG. 4. Note that the same or equivalent constituent elements as those of the first embodiment are denoted by the same reference numerals, and redundant explanation will be omitted except when particularly described.

Figure 4:
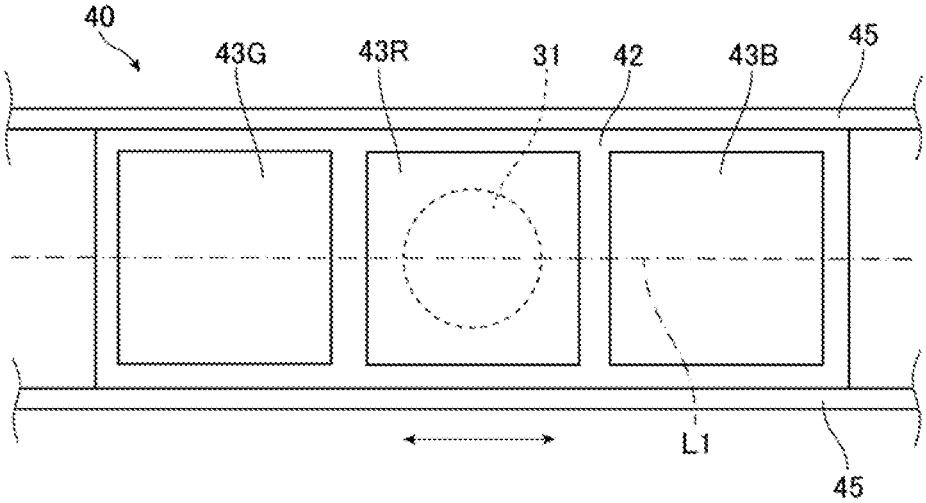
FIG. 4 is a front view schematically showing a diffraction grating unit of a vehicle lamp according to a second embodiment of the present invention.

FIG. 4 is a front view schematically showing a diffraction grating unit of a vehicle lamp as a vehicle lamp according to the present embodiment. The lamp unit of the vehicle lamp of the present embodiment is different from the lamp unit 20 in the first embodiment in points that the motor 50 and the motor driver 51 are not provided, a drive device (not shown) is provided, and the diffraction gratings 43R, 43G, 43B in the diffraction grating unit 40 as shown in FIG. 4 are arranged on the support member 42 side by side on one straight line. The lamp unit 20 of the present embodiment includes the light source 30, the diffraction grating unit 40, the drive device, the control unit 60, and the input unit 61 as main components. Note that the lamp unit 20 is fixed to the housing 10 by a configuration (not shown).

The support member 42 in the diffraction grating unit of the present embodiment is a plate-shaped member having an approximately quadrangular outer shape in a front view, and the support member 42 is supported to be sandwiched by two rails 45 extending in a direction perpendicular to the plate thickness direction. A drive device (not shown) is connected to the support member 42 of the present embodiment, and the support member 42 is configured to be capable of reciprocating along two rails 45. Furthermore, an encoder (not shown) that detects a position with respect to the rail 45 is attached to the support member 42 of the present embodiment. As a configuration of the drive device, for example, there are a configuration including a motor, a pulley that rotates by the motor, and a rod that connects the pulley and the support member 42, a configuration including an electromagnet attached to the rail 45 and a permanent magnet attached to the support member 42, a configuration including a motor, a pinion that rotates with the motor, and a rack that engages with the pinion and is attached to the support member 42, or the like. As the encoder, for example, a linear absolute encoder or the like can be used.

The support member 42 of the present embodiment is formed with three through holes penetrating in the plate thickness direction of the support member 42, the three diffraction gratings 43R, 43G, 43B are fitted into the through holes, respectively, and the three diffraction gratings 43R, 43G, 43B are fixed to the support member 42. Therefore, when the support member 42 reciprocates along the rail 45, the diffraction gratings 43R, 43G, 43B reciprocate along the rail 45. The three diffraction gratings 43R, 43G, 43B thus supported by the support member are arranged on a straight line L1 parallel to the reciprocating direction of the support member 42. The straight line L1 crosses the region 31 on which the laser light emitted from the light source 30 is incident. Therefore, by movement of the support member 42 to a predetermined position along the rail 45 with respect to each of the diffraction gratings 43R, 43G, 43B, the diffraction gratings 43R, 43G, 43B and the region 31 on which the laser light emitted from the light source 30 is incident overlap with each other, and the laser light emitted from the light source 30 can be incident on the diffraction gratings 43R, 43G, 43B.

Each of the diffraction gratings 43R, 43G, 43B of the present embodiment has a diffraction grating pattern (not shown) in each of grating regions (not shown) formed by being divided in the reciprocating direction of the support member 42 in a front view and a direction perpendicular to the reciprocating direction. The grating regions are formed so that when the diffraction gratings 43R, 43G, 43B and the region 31 on which the laser light emitted from the light source 30 is incident overlap, one or more of the grating regions are located in this region 31. Then, also in the present embodiment, as similar to the first embodiment, the diffraction gratings 43R, 43G, 43B diffract the red laser light LR, the green laser light LG, and the blue laser light LB that are emitted from the light source 30 and are incident on the diffraction gratings 43R, 43G, 43B so that each piece of the light emitted from the diffraction gratings 43R, 43G, 43B overlaps the light distribution pattern of the low beam L, and has the intensity distribution based on the intensity distribution of the low beam light distribution pattern.

In the present embodiment, the above-mentioned control unit 60 controls the emission state of the laser light of the light source 30 and the drive state of the drive device (not shown) to emit light from the vehicle lamp 1. Specifically, the control unit 60 of the present embodiment drives the drive device to move the diffraction grating unit 40 along the rail 45 to a position where the diffraction grating 43R corresponding to the red laser light LR overlaps the entire region 31, and when the diffraction grating 43R and the entire region 31 overlap with each other, the red laser light LR is emitted from the light source 30 for a predetermined time. The red laser light LR emitted from the light source 30 is incident on the diffraction grating 43R and is diffracted by the diffraction grating 43R as described above, and the red component light DLR of the low beam light distribution pattern is emitted from the diffraction grating 43R for a predetermined time. The red component light DLR of the light distribution pattern of the low beam L is emitted from the vehicle lamp 1 through the front cover 12 for a predetermined time.

Next, the control unit 60 moves the diffraction grating unit 40 along the rail 45 to a position where the diffraction grating 43G corresponding to the green laser light LG overlaps the entire region 31, and when the diffraction grating 43G and the entire region 31 overlap with each other, the green laser light LG is emitted from the light source 30 for a predetermined time. In the present embodiment, the emission time length of the green laser light LG is approximately the same as the emission time length of the red laser light LR. The green laser light LG emitted from the light source 30 is incident on the diffraction grating 43G and is diffracted by the diffraction grating 43G as described above, and the green component light DLG of the light distribution pattern of the low beam L is emitted from the diffraction grating 43G for a predetermined time. The green component light DLG of the light distribution pattern of the low beam L is emitted from the vehicle lamp 1 through the front cover 12 for a predetermined time.

Next, the control unit 60 moves the diffraction grating 43B corresponding to the blue laser light LB along the rail 45 to a position where the diffraction grating 43B overlaps the entire region 31, and when the diffraction grating 43B and the entire region 31 overlap with each other, the blue laser light LB is emitted from the light source 30 for a predetermined time. In the present embodiment, the emission time length of the blue laser light LB is approximately the same as the emission time length of the red laser light LR described above. The blue laser light LB emitted from the light source 30 is incident on the diffraction grating 43B and is diffracted by the diffraction grating 43B as described above, and the blue component light DLB of the light distribution pattern of the low beam L is emitted from the diffraction grating 43B for a predetermined time. The blue component light DLB of the light distribution pattern of the low beam L is emitted from the vehicle lamp 1 through the front cover 12 for a predetermined time.

The control unit 60 controls the emission state of the laser light of the light source 30 and the drive state of the drive device so that movement of the diffraction grating unit 40, emission of the red laser light LR from the light source 30, movement of the diffraction grating unit 40, emission of the green laser light LG from the light source 30, movement of the diffraction grating unit 40, and emission of the blue laser light LB from the light source 30 are sequentially repeated. That is, the emission of the red laser light LR, the green laser light LG, and the blue laser light LB of the light source 30 in a time division manner and the reciprocating of the diffraction grating unit 40 are synchronized with each other. Then, from the vehicle lamp 1, the red component light DLR of the light distribution pattern of the low beam L, the green component light DLG of the light distribution pattern of the low beam L, and the blue component light DLB of the light distribution pattern of the low beam L are sequentially and repeatedly emitted. Even with such a configuration, when the red laser light LR, the green laser light LG, and the blue laser light LB are repeatedly emitted in a cycle shorter than the time resolution of human vision, the vehicle lamp 1 can apply light having the light distribution pattern of the low beam L by the afterimage phenomenon. Furthermore, the color balance of the light applied by the afterimage phenomenon can be adjusted by adjusting the intensity of each piece of laser light LR, LG, LB emitted from the light source 30 and the length of the emission time of each piece of laser light LR, LG, LB. Therefore, the vehicle lamp 1 of the present embodiment enables adjustment of the color balance without measures such as replacement of the light source 30. Furthermore, as described above, since the plurality of pieces of laser light LR, LG, LB having different wavelengths are diffracted by the diffraction gratings 43R, 43G, 43B corresponding to the laser light of the respective wavelengths, respectively, it is easy to make the regions irradiated with the light DLR, DLG, DLB emitted from the diffraction gratings 43R, 43G, 43B overlap with each other, and it is easy to form a desired light distribution pattern by the afterimage phenomenon.

Furthermore, the vehicle lamp 1 of the present embodiment includes the support member 42 that supports the three diffraction gratings 43R, 43G, 43B and reciprocates. These diffraction gratings 43R, 43G, 43B are arranged on the straight line L1 parallel to the reciprocating direction of the support member 42, and emission of the red laser light LR, emission of the green laser light LG, and emission of the blue laser light LB of the light source 30 in a time division manner, and the reciprocating of the diffraction grating unit 40 (support member 42) are synchronized with each other. With such a configuration, in the vehicle lamp 1, the laser light LR, LG, LB can be incident on the diffraction gratings 43R, 43G, 43B corresponding to the respective laser light LR, LG, LB without adjusting the irradiation angle of the laser light LR, LG, LB emitted from the light source 30. Therefore, as similar to the first embodiment, as compared to the case where the drive mechanism for adjusting the irradiation angle of the laser light emitted from the light source is provided, the configuration can be simplified.

Note that, in the present embodiment as well, as shown by the broken line in FIG. 3A, the sign visual recognition light OHS may be emitted. In this case, it is preferable that the light distribution patterns of the light DLR, DLG, DLB emitted from the respective diffraction gratings 43R, 43G, 43B include a light distribution pattern overlapping with the region irradiated with the sign visual recognition light OHS, and including the intensity distribution of the sign visual recognition light OHS, and it is more preferable that the light distribution patterns include a light distribution pattern having an outer shape matching with at least some of the outer shape of the region irradiated with the sign visual recognition light OHS, and including the intensity distribution of the sign visual recognition light OHS. Moreover, it is more preferable that this outer shape matches with the entire outer shape of the region irradiated with the sign visual recognition light OHS.

Third Embodiment

Next, a third embodiment of the present invention will be described in detail with reference to FIG. 5. Note that the same or equivalent constituent elements as those of the first embodiment are denoted by the same reference numerals, and redundant explanation will be omitted except when particularly described.

Figure 5:
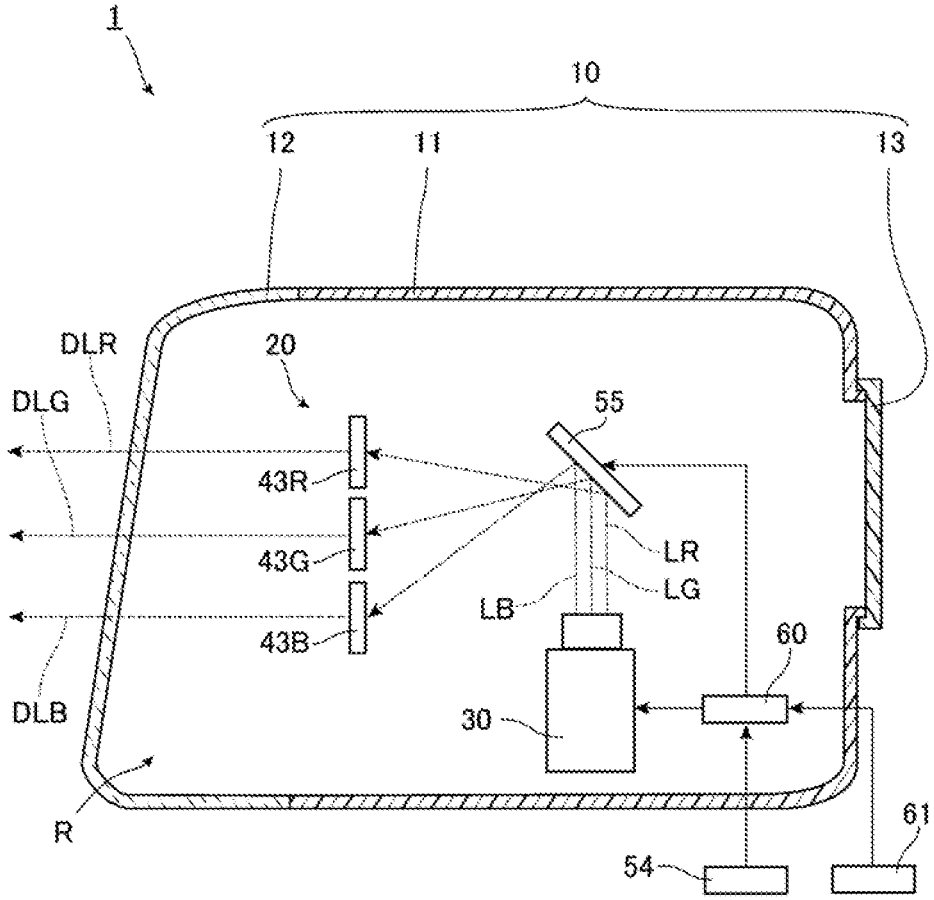
FIG. 5 is a diagram showing a vehicle lamp according to a third embodiment of the present invention from the same viewpoint as FIG. 1.

FIG. 5 is a diagram showing a vehicle lamp as a vehicle lamp according to the present embodiment from the same viewpoint as FIG. 1. As shown in FIG. 5, the lamp unit 20 of the vehicle lamp 1 according to the present embodiment is different from the lamp unit 20 in the first embodiment in points that an optical path changing element 55 is provided, and the motor 50, the motor driver 51, and the support member 42 are not provided. The lamp unit 20 of the present embodiment includes the light source 30, three diffraction gratings 43R, 43G, 43B, the optical path changing element 55, the control unit 60, and the input unit 61 as main components. Note that the lamp unit 20 is fixed to the housing 10 by a configuration (not shown).

The diffraction gratings 43R, 43G, 43B in the present embodiment diffract the red laser light LR, the green laser light LG, and the blue laser light LB, respectively, that are emitted from the light source 30 and are incident on the diffraction gratings 43R, 43G, 43B, so that each piece of the light emitted from the diffraction gratings 43R, 43G, 43B overlaps the light distribution pattern of the low beam L, and has the intensity distribution based on the intensity distribution of the low beam light distribution pattern, at the focal position that is a predetermined distance away from the vehicle. That is, at the focal position that is a predetermined distance away from the vehicle, the regions irradiated with the light emitted from the diffraction gratings 43R, 43G, 43B overlap with each other. The focal position is, for example, 25 m away from the vehicle. Note that, as similar to the first embodiment and the second embodiment described above, the diffraction gratings 43R, 43G, 43B have a diffraction grating pattern in each of the divided plurality of grating regions, and diffract the pieces of incident laser light LR, LG LB, respectively, so that each diffraction grating pattern is such a light distribution pattern.

The optical path changing element 55 of the present embodiment guides the red laser light LG, the green laser light LG, and the blue laser light LB emitted from the light source 30 to the diffraction gratings 43R, 43G, 43B corresponding to the laser light LR, LG, LB, respectively. As the optical path changing element 55, for example, a micro electro mechanical systems (MEMS) mirror, a polygon mirror, or the like can be used.

In the present embodiment, the control unit 60 controls the emission state of the laser light of the light source 30 and the drive state of the optical path changing element 55 to emit light from the vehicle lamp 1. Specifically, the control unit 60 of the present embodiment drives the optical path changing element 55 so that the red laser light LR incident on the optical path changing element 55 is incident on the diffraction grating 43R, and causes the light source 30 to emit the red laser light LR for a predetermined time. The red laser light LR emitted from the light source 30 is incident on the diffraction grating 43R and is diffracted by the diffraction grating 43R as described above, and the red component light DLR of the light distribution pattern of the low beam L is emitted from the diffraction grating 43R for a predetermined time. The red component light DLR of the light distribution pattern of the low beam L is emitted from the vehicle lamp 1 through the front cover 12 for a predetermined time.

Next, the control unit 60 drives the optical path changing element 55 so that the green laser light LG incident on the optical path changing element 55 is incident on the diffraction grating 43G, and causes the light source 30 to emit the green laser light LG for a predetermined time. In the present embodiment, the emission time length of the green laser light LG is approximately the same as the emission time length of the red laser light LR. The green laser light LG emitted from the light source 30 is incident on the diffraction grating 43G and is diffracted by the diffraction grating 43G as described above, and the green component light DLG of the light distribution pattern of the low beam L is emitted from the diffraction grating 43G for a predetermined time. The green component light DLG of the light distribution pattern of the low beam L is emitted from the vehicle lamp 1 through the front cover 12 for a predetermined time.

Next, the control unit 60 drives the optical path changing element 55 so that the blue laser light LB incident on the optical path changing element 55 is incident on the diffraction grating 43B, and causes the light source 30 to emit the blue laser light LG for a predetermined time. In the present embodiment, the emission time length of the blue laser light LB is approximately the same as the emission time length of the red laser light LR described above. The blue laser light LB emitted from the light source 30 is incident on the diffraction grating 43B and is diffracted by the diffraction grating 43B as described above, and the blue component light DLB of the light distribution pattern of the low beam L is emitted from the diffraction grating 43B for a predetermined time. The blue component light DLB of the light distribution pattern of the low beam L is emitted from the vehicle lamp 1 through the front cover 12 for a predetermined time.

The control unit 60 controls the emission state of the laser light of the light source 30 and the drive state of the optical path changing element 55 so that drive of the optical path changing element 55, emission of the red laser light LR from the light source 30, drive of the optical path changing element 55, emission of the green laser light LG from the light source 30, drive of the optical path changing element 55, and emission of the blue laser light LB from the light source 30 are sequentially repeated. That is, the emission of the plurality of pieces of laser light LR, LG, LB in a time division manner and the drive of the optical path changing element 55 are synchronized with each other. Then, from the vehicle lamp 1, the red component light DLR of the light distribution pattern of the low beam L, the green component light DLG of the light distribution pattern of the low beam L, and the blue component light DLB of the light distribution pattern of the low beam L are sequentially and repeatedly emitted. Even with such a configuration, when the red laser light LR, the green laser light LG, and the blue laser light LB are repeatedly emitted in a cycle shorter than the time resolution of human vision, the vehicle lamp 1 can apply light having the light distribution pattern of the low beam L by the afterimage phenomenon. Furthermore, the color balance of the light applied by the afterimage phenomenon can be adjusted by adjusting the intensity of each piece of laser light LR, LG, LB emitted from the light source 30 and the length of the emission time of each piece of laser light LR, LG, LB. Therefore, the vehicle lamp 1 of the present embodiment enables adjustment of the color balance without measures such as replacement of the light source 30. Furthermore, as described above, since the plurality of pieces of laser light LR, LG, LB having different wavelengths are diffracted by the diffraction gratings 43R, 43G, 43B corresponding to the laser light of the respective wavelengths, respectively, it is easy to make the regions irradiated with the light DLR, DLG, DLB emitted from the diffraction gratings 43R, 43G, 43B overlap with each other, and it is easy to form a desired light distribution pattern by the afterimage phenomenon.

Furthermore, the vehicle lamp 1 of the present embodiment includes the optical path changing element 55 that guides the red laser light LR, the green laser light LG, and the blue laser light LB emitted from the light source 30 to the diffraction gratings 43R, 43G, 43B corresponding to the laser light LR, LG, LB, respectively. With this configuration, the degree of freedom in the positional relationship between the light source 30 and the diffraction gratings 43R, 43G, 43B is improved and the size can be reduced as compared with the case where the optical path changing element is not provided. Furthermore, in the vehicle lamp 1, the laser light LR, LG, LB can be incident on the diffraction gratings 43R, 43G, 43B corresponding to the laser light LR, LG, LB, respectively, without adjusting the irradiation angle of the laser light LR, LG, LB emitted from the light source 30. Therefore, as similar to the first embodiment, as compared to the case where the drive mechanism for adjusting the irradiation angle of the laser light emitted from the light source is provided, the configuration can be simplified.

Note that, in the present embodiment as well, as shown by the broken line in FIG. 3A, the sign visual recognition light OHS may be emitted. In this case, it is preferable that the light distribution patterns of the light DLR, DLG, DLB emitted from the respective diffraction gratings 43R, 43G, 43B include a light distribution pattern overlapping with the region irradiated with the sign visual recognition light OHS, and including the intensity distribution of the sign visual recognition light OHS, and it is more preferable that the light distribution patterns include a light distribution pattern having an outer shape matching with at least some of the outer shape of the region irradiated with the sign visual recognition light OHS, and including the intensity distribution of the sign visual recognition light OHS. Moreover, it is more preferable that this outer shape matches with the entire outer shape of the region irradiated with the sign visual recognition light OHS.

Note that, in the first, second, and third embodiments described above, the vehicle lamp 1 is the vehicular headlamp that applies the low beam L by the afterimage phenomenon, but the present invention is not particularly limited. For example, the vehicle lamp may apply high beam H by the afterimage phenomenon, or may apply light forming an image by the afterimage phenomenon. When the vehicle lamp applies the high beam H by the afterimage phenomenon, the light of the light distribution pattern of the high beam H, which is the light distribution pattern for night illumination shown in FIG. 3B, is applied by the afterimage phenomenon. Note that, in the light distribution pattern of the high beam H shown in FIG. 3B, the region HA1 is the region having the highest intensity, and the region HA2 is the region having the lower intensity than the region HA1.

That is, each of the diffraction gratings diffracts the light so that the light obtained by synthesizing by the afterimage phenomenon forms a light distribution pattern including the intensity distribution of the high beam H. Furthermore, when the vehicle lamp applies the light forming an image by the afterimage phenomenon, the direction of the light emitted by the vehicle lamp and the position where the vehicle lamp is attached to the vehicle are not particularly limited.

In the first, second, and third embodiments described above, the light source 30 that emits the red laser light LR, the green laser light LG, and the blue laser light LB in a time division manner is described as an example. However, in the first, second, and third embodiments, the light source only needs to be capable of emitting a plurality of pieces of laser light having different wavelengths in a time division manner, for example, the light source may be a light source that emits two pieces of laser light having different wavelengths in a time division manner, or may be a light source that emits three or more pieces of laser light having different wavelengths in a time division manner.

Furthermore, in the first, second, and third embodiments, the vehicle lamp 1 including the input unit 61 has been described as an example. However, in the first, second, and third embodiments described above, the vehicle lamp may not include the input unit 61. In such a case, for example, the control unit controls the emission state of the laser light of the light source on the basis of a predetermined set value or the like regarding the intensity of the laser light emitted from the light source or the emission time length of the laser light. By adjusting this predetermined set value when manufacturing a vehicle lamp, or the like, the intensity of the laser light emitted from the light source and the emission time length of the laser light can be adjusted, and the color balance of the light applied by the afterimage phenomenon can be adjusted. Therefore, the vehicle lamp of such a configuration enables adjustment of the color balance without measures such as replacement of the light source.

Furthermore, although the transmissive diffraction gratings 43R, 43G, 43B are described as an example in the first, second, and third embodiments, the diffraction grating may be a reflection type diffraction grating. Furthermore, in the first, second, and third embodiments, the lamp unit 20 including each one of diffraction gratings 43R, 43G, 43B corresponding to the laser light LR, LG, LB emitted from the light source 30 is described as an example. However, in the first, second, and third embodiments described above, the lamp unit 20 may include a plurality of diffraction gratings 43R, 43G, 43B corresponding to the laser light LR, LG, LB.

Furthermore, in the first embodiment, the support member 42 having the circular outer shape of the front view and the diffraction gratings 43R, 43G, 43B having an outer shape of the approximately fan shape of the front view are described as an example. However, these outer shapes are not particularly limited. Furthermore, in the second embodiment, the support member 42 having the quadrangular outer shape of the front view and the diffraction gratings 43R, 43G, 43B having a quadrangular outer shape of the front view are described as an example. However, these outer shapes are not particularly limited.

Furthermore, in the first embodiment described above, each of the diffraction gratings 43R, 43G, 43B has a diffraction grating pattern (not shown) in each of grating regions (not shown) formed by being divided in the radial direction and the circumferential direction of a circle C centering on the rotation axis 52A. Furthermore, in the second embodiment, each of the diffraction gratings 43R, 43G, 43B has a diffraction grating pattern (not shown) in each of grating regions (not shown) formed by being divided in the reciprocating direction of the support member 42 in a front view and a direction perpendicular to the reciprocating direction. However, the direction of division for forming the grating region of the diffraction grating is not particularly limited.

Furthermore, in the first and second embodiments, the diffraction grating unit 40 including the diffraction gratings 43R, 43G, 43B and the support member 42 has been described as an example. However, it is sufficient that the diffraction grating unit 40 includes at least the diffraction gratings 43R, 43G, 43B. For example, in the diffraction grating unit 40, the diffraction gratings 43R, 43G, 43B and the support member 42 may be formed integrally with each other. In such a case, a part of the diffraction gratings 43R, 43G, 43B may also serve as the support member 42.

Furthermore, in the first embodiment, the control unit 60 that controls the emission state of the laser light of the light source 30 and the rotation state of the output shaft 52 of the motor 50 so that rotation of the diffraction grating unit 40, emission of the red laser light LR from the light source 30, rotation of the diffraction grating unit 40, emission of the green laser light LG from the light source 30, rotation of the diffraction grating unit 40, emission of the blue laser light LB from the light source 30 are sequentially repeated, has been described as an example. However, it is sufficient that the control unit 60 controls the emission state of the laser light of the light source 30 and the rotation state of the output shaft 52 of the motor 50 so that pieces of the laser light LR, LG, LB emitted from the light source 30 in a time division manner are incident on the diffraction gratings 43R, 43G, 43B corresponding to the laser light LR, LG, LB, respectively. For example, the control unit 60 may control the rotation state of the output shaft 52 of the motor 50 so that the support member 42 continues to rotate at a constant rotation speed that is synchronized with the emission timing of the laser light of the light source 30 in a time division manner. In such a case, the laser light LR, LG, LB is incident on the diffraction gratings 43R, 43G, 43B that are rotating.

Furthermore, in the second embodiment, the control unit 60 that controls the emission state of the laser light of the light source 30 and the drive state of the drive device so that movement of the diffraction grating unit 40, emission of the red laser light LR from the light source 30, movement of the diffraction grating unit 40, emission of the green laser light LG from the light source 30, movement of the diffraction grating unit 40, emission of the blue laser light LB from the light source 30 are sequentially repeated, has been described as an example. However, it is sufficient that the control unit 60 controls the emission state of the laser light of the light source 30 and the drive state of the drive device so that pieces of the laser light LR, LG, LB emitted from the light source 30 in a time division manner are incident on the diffraction gratings 43R, 43G, 43B corresponding to the pieces of laser light LR, LG, LB, respectively. For example, the control unit 60 may control the drive state of the drive device so that the support member 42 continues to reciprocate at a constant time interval that is synchronized with the emission timing of the laser light in a time division manner of the light source 30. In such a case, the laser light LR, LG, LB is incident on the diffraction gratings 43R, 43G, 43B that are reciprocating.

Furthermore, it is sufficient that the laser light of respective wavelengths emitted from the light source is incident on the diffraction gratings corresponding to respective pieces of laser light. For example, the vehicle lamp may include a drive mechanism for adjusting the irradiation angle of the laser light emitted from the light source, and the drive mechanism may adjust the irradiation angle of the laser light to cause the laser light to be incident on the corresponding diffraction grating.

Fourth Embodiment

Figure 6:
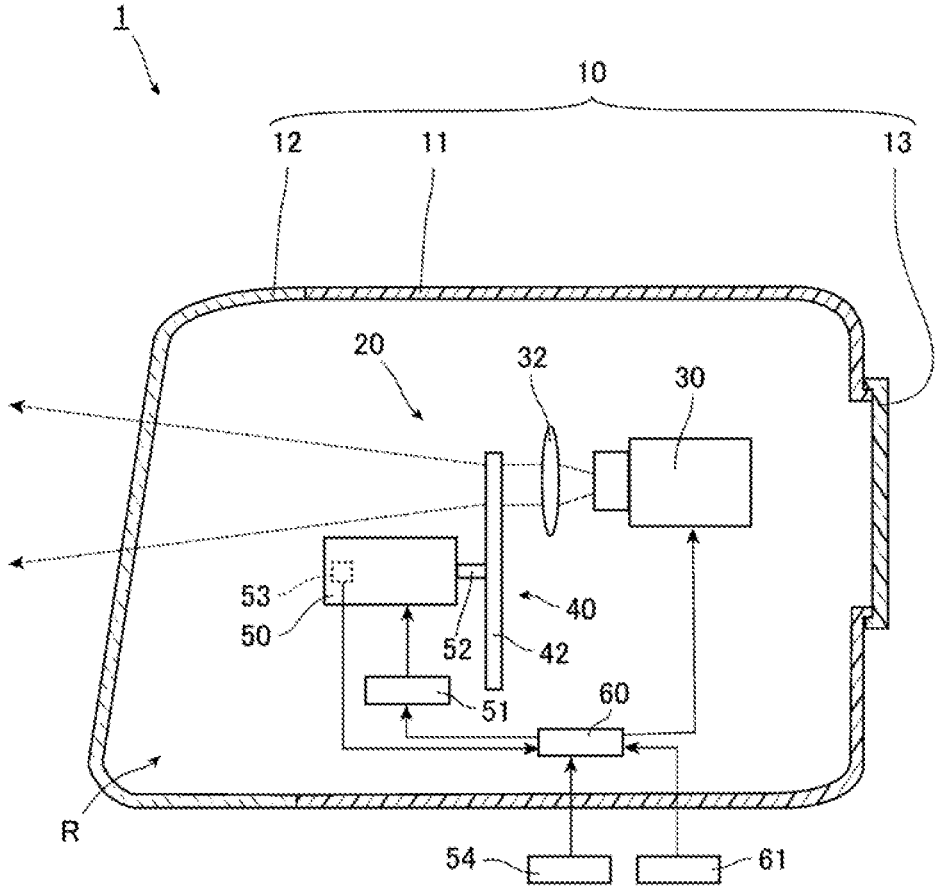
FIG. 6 is a diagram showing an example of a vehicle lamp according to a fourth embodiment of the present invention.

Next, a fourth embodiment of the present invention will be described. Note that the same or equivalent constituent elements as those of the first embodiment described above are denoted by the same reference numerals, and redundant explanation will be omitted except when particularly described. FIG. 6 is a diagram showing an example of a vehicle lamp according to the present embodiment, and is a diagram schematically showing a vertical cross section of the vehicle lamp. As shown in FIG. 6, the light emitted from the light source 30 of the present embodiment is different from the light emitted from the light source 30 of the first embodiment, and the light emitted from the diffraction grating unit 40 of the present embodiment is different from the light emitted from the diffraction grating unit 40 of the first embodiment.

The light source 30 of the present embodiment includes a light emitting element (not shown) that emits red laser light having a power peak wavelength of, for example, 638 nm, a light emitting element (not shown) that emits green laser light having a power peak wavelength of, for example, 515 nm, a light emitting element (not shown) that emits blue laser light having a power peak wavelength of, for example, 445 nm, and a drive circuit (not shown). Electric power is supplied to these light emitting elements via the drive circuit. In such a light source 30, the power supplied to each light emitting element can be adjusted to adjust the intensity of the laser light emitted from each light emitting element, and these pieces of laser light can be synthesized to emit laser light of a desired color. As the light source 30, for example, a semiconductor laser or the like in which a light emitting element is a laser element that emits laser light can be used.

In the present embodiment, a collimator lens 32 is provided separately from the light source 30. The collimator lens 32 is a lens that collimates the fast axis direction and the slow axis direction of the laser light emitted from the light source 30. The collimator lens 32 may be provided integrally with the light source 30, and instead of the collimator lens 32, a collimator lens that collimates the fast axis direction of the laser light and a collimator lens that collimates the slow axis direction of the laser light may be separately provided.

Figure 7:
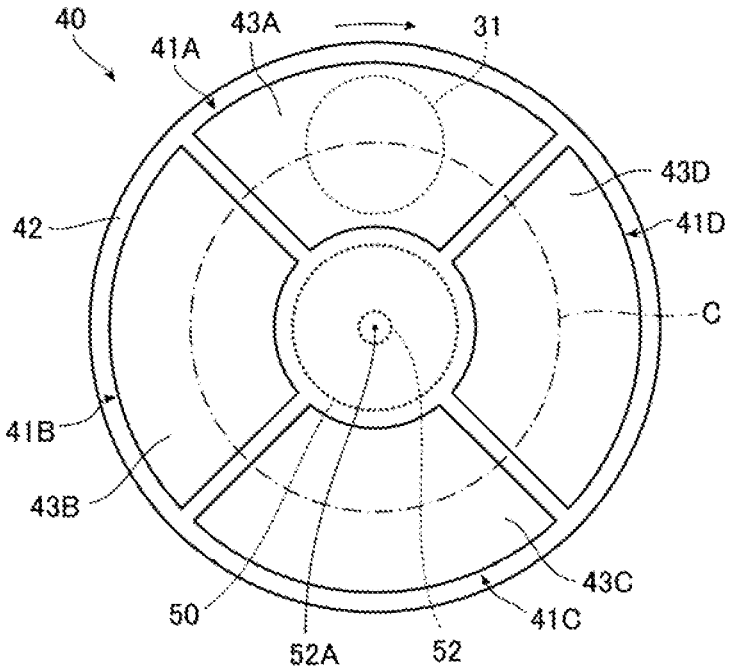
FIG. 7 is a front view schematically showing a diffraction grating unit of FIG. 6.

FIG. 7 is a front view schematically showing the diffraction grating unit shown in FIG. 6. The diffraction grating unit 40 of the present embodiment includes four light distribution pattern forming units 41A, 41B, 41C, 41D and the support member 42 as main components, and the laser light emitted from the light source 30 is incident on the diffraction grating unit 40. Note that, in FIG. 7, a region 31 on which the laser light emitted from the light source 30 is incident is shown by a broken line.

In the present embodiment, the four light distribution pattern forming units 41A, 41B, 41C, 41D are composed of transmissive diffraction gratings 43A, 43B, 43C, 43D, respectively, and these diffraction gratings diffract the light incident from one surface, and emit the diffracted light from the other surface. Furthermore, these diffraction gratings are fitted into the four through holes formed in the support member 42 and fixed to the support member 42. Therefore, when the support member 42 rotates about the rotation axis 52A of the output shaft 52 as a rotation axis, these diffraction gratings rotate about the rotation axis 52A. These diffraction gratings supported by the support member 42 as described above are arranged on the circumference of a circle C centering on the rotation axis 52A when viewed from the rotation axis 52A of the output shaft 52. Note that the order in which these diffraction gratings are arranged in the circumferential direction of the circle C is not particularly limited. The circumference crosses the region 31 on which the laser light emitted from the collimator lens 32 is incident. Therefore, by rotating the support member 42 by a predetermined angle, the diffraction gratings 43A, 43B, 43C, 43D and the region 31 on which the laser light emitted from the collimator lens 32 is incident can overlap with each other, and thus the laser light emitted from the collimator lens 32 can be incident on the diffraction gratings 43A, 43B, 43C, 43D. Therefore, the four light distribution pattern forming units 41A, 41B, 41C, 41D include the diffraction gratings 43A, 43B, 43C, 43D, respectively, that are arranged on the circumference of the circle C centering on the rotation axis 52A of the output shaft 52 which is the rotation axis of the support member 42. Each laser light emitted from the light source 30 can be incident on these diffraction gratings via the collimator lens 32.

Each of the diffraction gratings 43A, 43B, 43C, 43D of the present embodiment has a diffraction grating pattern (not shown) in each of grating regions (not shown) formed by being divided in the radial direction and the circumferential direction of a circle C centering on the rotation axis 52A. The grating regions are formed so that when the diffraction gratings 43A, 43B, 43C, 43D and the region 31 on which the laser light emitted from the collimator lens 32 is incident overlap, one or more of the grating regions are located in this region 31.

The diffraction gratings 43A, 43B, 43C, 43D of the present embodiment diffract the laser light emitted from the collimator lens 32 and emit light of predetermined light distribution patterns that are different from each other. That is, the light distribution pattern forming units 41A, 41B, 41C, 41D of the present embodiment emit light of predetermined light distribution patterns that are different from each other. Specifically, the diffraction gratings 43A, 43B, 43C, 43D diffract the laser light emitted from the collimator lens 32 so that predetermined images that are different from each other are drawn when the light emitted from the diffraction gratings 43A, 43B, 43C, 43D is applied to an irradiation target object such as a road surface. An intensity distribution is also included in each of the light distribution patterns. The predetermined images that are different from each other include images having different sizes. Note that, as described above, each of the diffraction gratings 43A, 43B, 43C, 43D has a diffraction grating pattern in each of the divided plurality of grating regions, and diffracts the incident light so that each diffraction grating pattern is such a light distribution pattern. That is, the diffraction gratings 43A, 43B, 43C, 43D compose a set of a plurality of diffraction gratings having the same diffraction grating pattern.

In the present embodiment, the information input to the input unit 61 is information for selecting a predetermined image to be drawn. This predetermined image is selected from an image drawn when the light emitted from the diffraction grating 43A of the light distribution pattern forming unit 41A is applied to the irradiation target object such as a road surface, an image drawn when the light emitted from the diffraction grating 43B of the light distribution pattern forming unit 41B is applied to the irradiation target object such as a road surface, an image drawn when the light emitted from the diffraction grating 43C of the light distribution pattern forming unit 41C is applied to the irradiation target object such as a road surface, and an image drawn when the light emitted from the diffraction grating 43D of the light distribution pattern forming unit 41D is applied to the irradiation target object such as a road surface. Examples of the input unit 61 of the present embodiment include a rotary switch mounted on a circuit board.

Next, drawing of an image by the vehicle lamp 1 of the present embodiment will be described.

The above-mentioned control unit 60 detects, for example, a signal indicating the image drawing from the vehicle control device 54, and, in the case of the input state where the signal indicating the image drawing is input to the control unit 60, the above-mentioned control unit 60 controls the emission state of the laser light of the light source 30 and the rotation state of the output shaft 52 of the motor 50 to emit light from the vehicle lamp 1.

Specifically, the control unit 60 of the present embodiment drives the motor driver 51 on the basis of the signal input from the encoder 53 to the control unit 60 and the signal input from the input unit 61 to the control unit 60, rotates the diffraction grating unit 40 to a position where the diffraction grating of the light distribution pattern forming unit corresponding to the image selected by the user in the input unit 61 overlaps the entire region 31, and maintains the diffraction grating unit 40 so as not to move from that position. The position where the diffraction grating unit 40 is maintained is, for example, a position where the center of the diffraction grating matches the center of the region 31 in the rotation direction of the diffraction grating unit 40. Note that the rotation direction of the diffraction grating unit 40 is not particularly limited, and is clockwise in FIG. 7 in the present embodiment, and in FIG. 7, a state where the center of the diffraction grating 43A matches the center of the region 31 is illustrated.

Next, the control unit 60 drives the drive circuit to cause the light source 30 to emit laser light in a state where the diffraction grating of the light distribution pattern forming unit corresponding to the image selected by the user in the input unit 61 overlaps the entire region 31. The laser light emitted from the light source 30 is incident on the collimator lens 32 and is collimated by the collimator lens 32 as described above. The collimated laser light is incident on the diffraction grating of the light distribution pattern forming unit corresponding to the image selected by the user in the input unit 61 and is diffracted by the diffraction grating as described above, and the light of the predetermined light distribution pattern is emitted from the diffraction grating. The light of the predetermined light distribution pattern is emitted from the vehicle lamp 1 through the front cover 12. Thus, the vehicle lamp 1 emits light having a predetermined light distribution pattern from the diffraction grating of the light distribution pattern forming unit corresponding to the image selected by the user in the input unit 61, and the image based on the predetermined light distribution pattern is drawn on the irradiation target object such as a road surface. Therefore, when the image corresponding to the light distribution pattern forming unit 41A is selected in the input unit 61, light of a predetermined light distribution pattern is emitted from the diffraction grating 43A of the light distribution pattern forming unit 41A, and an image based on the light distribution pattern is drawn on the irradiation target object such as a road surface. Furthermore, when the image corresponding to the light distribution pattern forming unit 41B is selected, light of a predetermined light distribution pattern is emitted from the diffraction grating 43B of the light distribution pattern forming unit 41B, and an image based on the light distribution pattern is drawn on the irradiation target object such as a road surface. Furthermore, when the image corresponding to the light distribution pattern forming unit 41C is selected, light of a predetermined light distribution pattern is emitted from the diffraction grating 43C of the light distribution pattern forming unit 41C, and an image based on the light distribution pattern is drawn on the irradiation target object such as a road surface. Furthermore, when the image corresponding to the light distribution pattern forming unit 41D is selected, light of a predetermined light distribution pattern is emitted from the diffraction grating 43D of the light distribution pattern forming unit 41D and an image based on the light distribution pattern is drawn on the irradiation target object such as a road surface.

The color of the image drawn on the irradiation target object such as a road surface is the color of the light emitted from the light source 30, and the color of the light emitted from the light source 30 is not particularly limited. For example, the color of the light emitted from the light source 30 may be different or may be the same for each image drawn on the irradiation target object such as a road surface, that is, for each of the diffraction gratings 43A, 43B, 43C, 43D of the light distribution pattern forming units 41A, 41B, 41C, 41D.

By the way, in the state where the image selected by the user in the input unit 61 is drawn on the irradiation target object such as a road surface, when the selection of the image in the input unit 61 is changed and a signal indicating the selection of a new image is input from the input unit 61 to the control unit 60, the control unit 60 controls the emission state of the laser light of the light source 30 and the rotation state of the output shaft 52 of the motor 50 so that the newly selected predetermined image is drawn on the irradiation target object such as a road surface. Specifically, the control unit 60 of the present embodiment drives the drive circuit to stop the emission of the laser light from the light source 30. Next, the control unit 60 drives the motor driver 51 on the basis of the signal input from the encoder 53 to the control unit 60 and the signal input from the input unit 61 to the control unit 60, rotates the diffraction grating unit 40 to a position where the diffraction grating which is the light distribution pattern forming unit corresponding to the image newly selected by the user in the input unit 61 overlaps the entire region 31, and maintains the diffraction grating unit 40 so as not to move from that position. By the way, since the positions of these diffraction gratings with respect to the support member 42 do not change, by rotating the support member 42 by a predetermined angle, it is possible to make the diffraction grating of the light distribution pattern forming unit corresponding to the image newly selected by the user in the input unit 61 overlap the entire region 31.

Next, the control unit 60 drives the drive circuit to cause the light source 30 to emit the laser light in a state where the diffraction grating of the light distribution pattern forming unit corresponding to the image newly selected by the user in the input unit 61 overlaps the entire region 31. As described above, the laser light emitted from the light source 30 is incident on the collimator lens 32 and is collimated by the collimator lens 32. The collimated laser light is incident on the diffraction grating of the light distribution pattern forming unit corresponding to the image newly selected by the user in the input unit 61 and is diffracted by the diffraction grating, and the light of the predetermined light distribution pattern is emitted from the diffraction grating. The light of the predetermined light distribution pattern is emitted from the vehicle lamp 1 through the front cover 12. Thus, the vehicle lamp 1 emits light having a predetermined light distribution pattern from the diffraction grating of the light distribution pattern forming unit corresponding to the image newly selected by the user in the input unit 61, and the image based on the predetermined light distribution pattern is drawn on the irradiation target object such as a road surface.

In this way, the vehicle lamp 1 can draw an image on the irradiation target object such as a road surface, and can switch the image drawn on the road surface or the like.

Figure 8A:
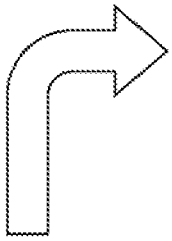
FIG. 8A to FIG. 8D are diagrams schematically showing examples of images to be drawn.
Figure 8B:
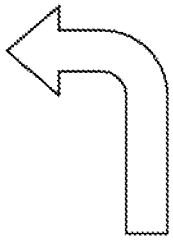
Figure 8C:
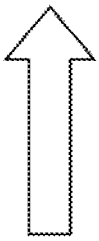
Figure 8D:
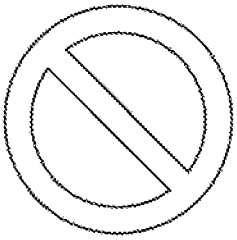

FIG. 8A to FIG. 8D are diagrams schematically showing examples of images to be drawn on an irradiation target object such as a road surface. Specifically, FIG. 8A is a diagram showing an image drawn by the light emitted from the diffraction grating 43A of the light distribution pattern forming unit 41A of the present embodiment. FIG. 8B is a diagram showing an image drawn by the light emitted from the diffraction grating 43B of the light distribution pattern forming unit 41B of the present embodiment. FIG. 8C is a diagram showing an image drawn by the light emitted from the diffraction grating 43C of the light distribution pattern forming unit 41C of the present embodiment. FIG. 8D is a diagram showing an image drawn by the light emitted from the diffraction grating 43D of the light distribution pattern forming unit 41D of the present embodiment. In FIG. 8A to FIG. 8D, the outline of the image is shown by a thick line. When these images are drawn on the road surface in front of the vehicle, the image shown in FIG. 8A is an arrow bent to the right as seen from the driver, the image shown in FIG. 8B is an arrow bent to the left as seen from the driver, and the image shown in FIG. 8C is an arrow extending forward as seen from the driver. Furthermore, the image shown in FIG. 8D is a mark similar to the parking prohibition sign as seen from the driver. For example, by drawing the image shown in FIG. 8A on the road surface in front of the vehicle, it is possible to display that the vehicle turns right, to a person outside the vehicle, such as a passerby or an occupant of another vehicle. Furthermore, by drawing the image shown in FIG. 8B on the road surface in front of the vehicle, it is possible to display that the vehicle turns left, to a person outside the vehicle. Furthermore, by drawing the image shown in FIG. 8C on the road surface in front of the vehicle, it is possible to display that the vehicle goes straight, to a person outside the vehicle. Furthermore, by drawing the image shown in FIG. 8D on the road surface in front of the vehicle, it is possible to display a user's intention that the user does not want the person outside the vehicle to park at the site where the image is drawn. Note that the image drawn by the vehicle lamp 1 on a road surface or the like, the position where the image is drawn with respect to the vehicle, and the position where the vehicle lamp 1 is attached to the vehicle are not particularly limited.

By the way, when a predetermined image is drawn by controlling the irradiation angle of the laser light emitted from the laser head as the laser drawing device of Patent Literature 2, a drive mechanism including a gear for adjusting the irradiation angle of the laser light, a drive motor, and the like tends to be complicated.

Therefore, the vehicle lamp 1 of the present embodiment includes the light source 30, the four light distribution pattern forming units 41A, 41B, 41C, 41D, and the support member 42 that supports the four light distribution pattern forming units 41A, 41B, 41C, 41D and rotates. The light distribution pattern forming units 41A, 41B, 41C, 41D include the diffraction gratings 43A, 43B, 43C, 43D, respectively, that are arranged on the circumference of the circle C centering on the rotation axis 52A of the output shaft 52 which is the rotation axis of the support member 42. The light distribution pattern of the light emitted from the diffraction grating 43A of the light distribution pattern forming unit 41A, the light distribution pattern of the light emitted from the diffraction grating 43B of the light distribution pattern forming unit 41B, the light distribution pattern of light emitted from the diffraction grating 43C of the light distribution pattern forming unit 41C, the light distribution pattern of the light emitted from the diffraction grating 43D of the light distribution pattern forming unit 41D are different from each other.

Therefore, the vehicle lamp 1 of the present embodiment can draw an image on a road surface or the like without adjusting the irradiation angle of the laser light emitted from the light source 30, and as compared to a vehicle lamp that draws an image on a road surface or the like by adjusting the irradiation angle of the light emitted from the light source, an image can be drawn on the road surface or the like with a simple configuration.

The diffraction gratings 43A, 43B, 43C, 43D of the light distribution pattern forming units 41A, 41B, 41C, 41D are arranged on the circumference of the circle C centering on the rotation axis 52A of the output shaft 52 which is the rotation axis of the support member 42. Therefore, by rotating the support member 42 by a predetermined angle, the diffraction grating on which the laser light emitted from the light source 30 is incident can be changed to the diffraction grating of another light distribution pattern forming unit. Furthermore, as described above, the light distribution pattern of the light emitted from the diffraction grating 43A of the light distribution pattern forming unit 41A, the light distribution pattern of the light emitted from the diffraction grating 43B of the light distribution pattern forming unit 41B, the light distribution pattern of the light emitted from the diffraction grating 43C of the light distribution pattern forming unit 41C, and the light distribution pattern of light emitted from the diffraction grating 43D of the light distribution pattern forming unit 41D are different from each other. Therefore, by rotating the support member 42 by a predetermined angle, the image drawn on the road surface or the like can be switched. Furthermore, a moving image can be drawn on a road surface or the like by continuously rotating the support member 42 and continuously switching the images. As described above, generally, when a component is rotationally moved, an operating noise tends to be less likely to be generated than when a component is reciprocated. Therefore, the vehicle lamp 1 can suppress the operating noise when switching the image drawn on the road surface or the like, as compared to the case of switching the image drawn on the road surface or the like by reciprocating the support member.

Fifth Embodiment

Next, a fifth embodiment of the present invention will be described in detail with reference to FIG. 9. Note that the same or equivalent constituent elements as those of the fourth embodiment are denoted by the same reference numerals, and redundant explanation will be omitted except when particularly described.

Figure 9:
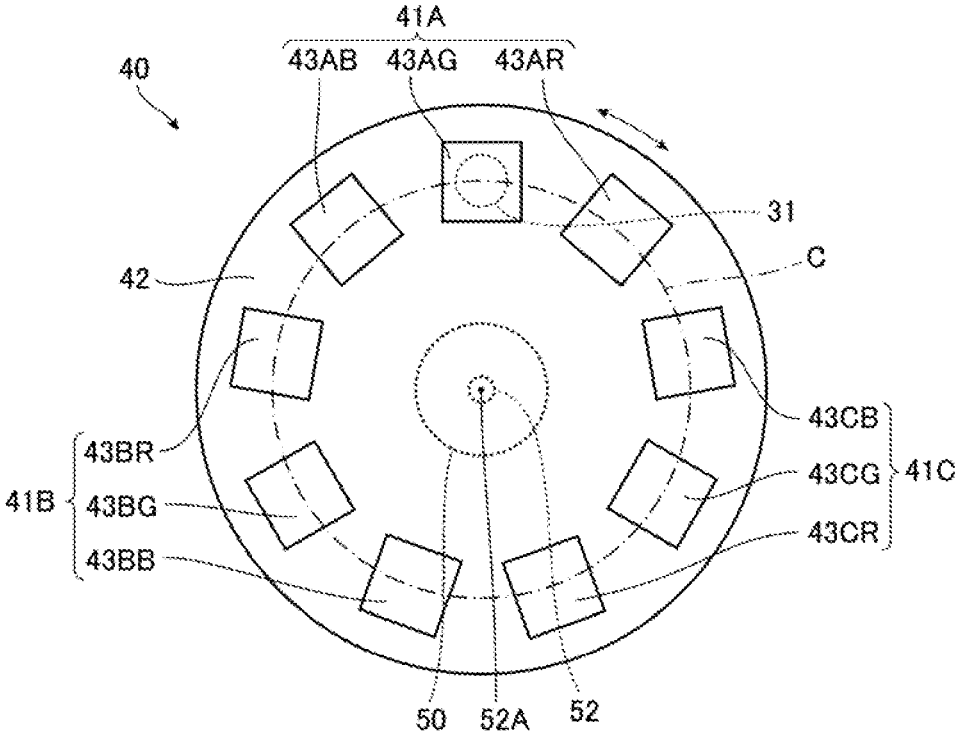
FIG. 9 is a front view schematically showing a diffraction grating unit of a vehicle lamp according to a fifth embodiment of the present invention.

FIG. 9 is a front view schematically showing a diffraction grating unit of a vehicle lamp according to the present embodiment. As shown in FIG. 9, the diffraction grating unit of the present embodiment is different from the diffraction grating unit 40 in the fourth embodiment in points that the support member 42 supports three light distribution pattern forming units, and each light distribution pattern forming unit includes a plurality of diffraction gratings. Furthermore, the lamp unit of the present embodiment is different from the lamp unit 20 in the fourth embodiment also in points that the light source 30 emits a plurality of pieces of laser light having different wavelengths in a time division manner, and the information input to the input unit 61 includes the intensity of a plurality of pieces of laser light having different wavelengths emitted from the light source 30 and the emission time length of each of the pieces of laser light, along with the information of the selection of the predetermined image to be drawn that has been described in the fourth embodiment. The lamp unit 20 of the present embodiment includes a light source 30, a diffraction grating unit 40, a motor 50, a motor driver 51, a control unit 60, and an input unit 61 as main components. Note that the lamp unit 20 is fixed to the housing 10 by a configuration (not shown).

The light source 30 of the present embodiment emits a plurality of pieces of laser light having different wavelengths in a time division manner. The light source 30 of the present embodiment includes a light emitting element that emits red laser light, a light emitting element that emits green laser light, a light emitting element that emits blue laser light, and a drive circuit, as similar to the light source 30 of the fourth embodiment. The light source 30 can emit the red laser light, the green laser light, and the blue laser light in a time division manner by adjusting the electric power supplied to each light emitting element, and the pieces of laser light emitted from the light source 30 are emitted to approximately the same region. That is, the light source 30 of the present embodiment is configured to switch the red laser light, the green laser light, and the blue laser light so that the laser light of any of the color can be emitted at a desired timing for a desired time. Furthermore, the light source 30 can adjust the intensity of each piece of the emitted laser light by adjusting the electric power supplied to each light emitting element. In the present embodiment, the intensity of the each piece of the laser light is adjusted so that the color of the light obtained by synthesizing the pieces of laser light is white in the initial state.

The diffraction grating unit 40 of the present embodiment includes three light distribution pattern forming units 41A, 41B, 41C and the support member 42 as main components, and the laser light emitted from the light source 30 is incident on the diffraction grating unit 40. Note that, in FIG. 4, a region 31 on which the laser light emitted from the light source 30 is incident is shown by a broken line.

In the present embodiment, the light distribution pattern forming unit 41A includes three diffraction gratings 43AR, 43AG, 43AB, the light distribution pattern forming unit 41B includes three diffraction gratings 43BR, 43BG, 43BB, and the light distribution pattern forming unit 41C includes three diffraction gratings 43CR, 43CG, 43CB. These diffraction gratings are fitted into the nine through holes formed in the support member 42 and fixed to the support member 42. Therefore, when the support member 42 rotates about the rotation axis 52A of the output shaft 52 as a rotation axis, these diffraction gratings rotate about the rotation axis 52A. These diffraction gratings supported by the support member 42 as described above are arranged on the circumference of a circle C centering on the rotation axis 52A when viewed from the rotation axis 52A of the output shaft 52. Furthermore, these diffraction gratings are arranged side by side for each of the light distribution pattern forming units 41A, 41B, 41C in the circumferential direction of the circle C. Specifically, in the light distribution pattern forming unit 41A, the diffraction grating 43AR is located next to one side of the diffraction grating 43AG and the diffraction grating 43AB is located next to the other side in the circumferential direction of the circle C. Furthermore, in the light distribution pattern forming unit 41B, the diffraction grating 43BR is located next to one side of the diffraction grating 43BG and the diffraction grating 43BB is located next to the other side in the circumferential direction of the circle C. Furthermore, in the light distribution pattern forming unit 41C, the diffraction grating 43CR is located next to one side of the diffraction grating 43CG and the diffraction grating 43CB is located next to the other side in the circumferential direction of the circle C. The circumference of this circle C crosses the region 31 on which the laser light emitted from the light source 30 is incident. Therefore, by rotating the support member 42 by a predetermined angle, these diffraction gratings and the region 31 on which the laser light emitted from the light source 30 is incident can overlap with each other, and thus the laser light emitted from the light source 30 can be incident on these diffraction gratings. Therefore, the laser light emitted from the light source 30 can be incident on the three light distribution pattern forming units 41A, 41B, 41C.

In the present embodiment, each of the diffraction gratings 43AR, 43AG, 43AB, 43BR, 43BG, 43BB, 43CR, 43CG, 43CB is a transmissive diffraction grating, and has a diffraction grating pattern (not shown) in each of grating regions (not shown) formed by being divided in the radial direction and the circumferential direction of a circle centering on the rotation axis 52A, as similar to the diffraction gratings of the fourth embodiment described above. The grating regions are formed so that when these diffraction gratings and the region 31 on which the laser light emitted from the light source 30 is incident overlap, one or more of the grating regions are located in this region 31.

In the present embodiment, the diffraction gratings 43AR, 43BR, 43CR correspond to the red laser light emitted from the light source 30, and the red laser light is incident on each of the diffraction gratings 43AR, 43BR, 43CR and is diffracted. Furthermore, the diffraction gratings 43AG, 43BG, 43CG correspond to the green laser light emitted from the light source 30, and the green laser light is incident on each of the diffraction gratings 43AG, 43BG, 43CG and is diffracted. Furthermore, the diffraction gratings 43AB, 43BB, 43CB correspond to the blue laser light emitted from the light source 30, and the blue laser light is incident on each of the diffraction gratings 43AB, 43BB, 43CB and is diffracted. Therefore, the light distribution pattern forming units 41A, 41B, 41C include each one from sets of the diffraction gratings 43AR, 43BR, 43CR corresponding to the red laser light, the diffraction gratings 43AG, 43BG, 43CG corresponding to the green laser light, and the diffraction gratings 43AB, 43BB, 43CB corresponding to the blue laser light.

The light emitted from the diffraction gratings 43AR, 43BR, 43CR by the red laser light being diffracted by the diffraction gratings 43AR, 43BR, 43CR is red. The light emitted from the diffraction gratings 43AG, 43BG, 43CG by the green laser light being diffracted by the diffraction gratings 43AG, 43BG, 43CG is green. The light emitted from the diffraction gratings 43AB, 43BB, 43CB by the blue laser light being diffracted by the diffraction gratings 43AB, 43BB, 43CB is blue.

The light incident on the diffraction gratings 43AR, 43AG, 43AB of the light distribution pattern forming unit 41A is diffracted by the diffraction gratings 43AR, 43AG, 43AB so that the light of a predetermined light distribution pattern is emitted from the diffraction gratings 43AR, 43AG, 43AB. Furthermore, the light incident on the diffraction gratings 43BR, 43BG, 43BB of the light distribution pattern forming unit 41B is diffracted by the diffraction gratings 43BR, 43BG, 43BB so that the light of a predetermined light distribution pattern is emitted from the diffraction gratings 43BR, 43BG, 43BB. Furthermore, the light incident on the diffraction gratings 43CR, 43CG, 43CB of the light distribution pattern forming unit 41C is diffracted by the diffraction gratings 43CR, 43CG, 43CB so that the light of a predetermined light distribution pattern is emitted from the diffraction gratings 43CR, 43CG, 43CB. The light distribution pattern of the light emitted from the diffraction gratings 43AR, 43AG, 43AB, the light distribution pattern of the light emitted from the diffraction gratings 43BR, 43BG, 43BB, and the light distribution pattern of light emitted from the diffraction gratings 43CR, 43CG, 43CB are different from each other. That is, the light distribution pattern forming units 41A, 41B, 41C of the present embodiment emit light of predetermined light distribution patterns that are different from each other. Note that, as described above, the diffraction gratings have a diffraction grating pattern in each of the divided plurality of grating regions, and diffract the incident laser light so that each diffraction grating pattern is such a light distribution pattern. That is, the diffraction gratings compose a set of a plurality of diffraction gratings having the same diffraction grating pattern.

Specifically, the diffraction gratings 43AR, 43AG, 43AB of the light distribution pattern forming unit 41A diffract the red laser light, the green laser light, and the blue laser light emitted from the light source 30, respectively, so that the light obtained by synthesizing the light emitted from the diffraction gratings 43AR, 43AG, 43AB has a light distribution pattern in which the image shown in FIG. 8A is drawn. The intensity distribution is also included in the light distribution patterns. Therefore, the diffraction gratings 43AR, 43AG, 43AB of the present embodiment diffract the red laser light, the green laser light, and the blue laser light that are emitted from the light source 30 and are incident on the diffraction gratings 43AR, 43AG, 43AB so that each piece of the light emitted from the diffraction gratings 43AR, 43AG, 43AB overlaps the light distribution pattern in which the image is drawn, and has the intensity distribution based on the intensity distribution of the light distribution pattern in which the image is drawn. Thus, the red component light of the light distribution pattern in which the image shown in FIG. 8A is drawn is emitted from the diffraction grating 43AR, the green component light of the light distribution pattern in which the image is drawn is emitted from the diffraction grating 43AG, and the blue component light of the light distribution pattern in which the image is drawn is emitted from the diffraction grating 43AB. Note that the intensity distribution based on the intensity distribution of the light distribution pattern in which the image shown in FIG. 8A is drawn described above means that the intensity of each piece of light emitted from the diffraction gratings 43AR, 43AG, 43AB is high in the portion where the intensity in the light distribution pattern is high.

The diffraction gratings 43BR, 43BG, 43BB of the light distribution pattern forming unit 41B diffract the red laser light, the green laser light, and the blue laser light that are emitted from the light source 30 and are incident on the diffraction gratings 43BR, 43BG, 43BB so that each piece of the light emitted from the diffraction gratings 43AR, 43AG, 43AB overlaps the light distribution pattern in which the image shown in FIG. 8B is drawn, and has the intensity distribution based on the intensity distribution of the light distribution pattern in which the image is drawn, as similar to the diffraction gratings 43AR, 43AG, 43AB of the light distribution pattern forming unit 41A. Thus, the red component light of the light distribution pattern in which the image shown in FIG. 8B is drawn is emitted from the diffraction grating 43BR, the green component light of the light distribution pattern in which the image is drawn is emitted from the diffraction grating 43BG, and the blue component light of the light distribution pattern in which the image is drawn is emitted from the diffraction grating 43BB.

The diffraction gratings 43CR, 43CG, 43CB of the light distribution pattern forming unit 41C diffract the red laser light, the green laser light, and the blue laser light that are emitted from the light source 30 and are incident on the diffraction gratings 43CR, 43CG, 43CB so that each piece of the light emitted from the diffraction gratings 43CR, 43CG, 43CB overlaps the light distribution pattern in which the image shown in FIG. 8C is drawn, and has the intensity distribution based on the intensity distribution of the light distribution pattern in which the image is drawn, as similar to the diffraction gratings 43AR, 43AG, 43AB of the light distribution pattern forming unit 41A. Thus, the red component light of the light distribution pattern in which the image shown in FIG. 8C is drawn is emitted from the diffraction grating 43CR, the green component light of the light distribution pattern in which the image is drawn is emitted from the diffraction grating 43CG, and the blue component light of the light distribution pattern in which the image is drawn is emitted from the diffraction grating 43CB.

The light distribution pattern of light emitted from the diffraction gratings 43AR, 43AG, 43AB of the light distribution pattern forming unit 41A, the light distribution pattern of light emitted from the diffraction gratings 43BR, 43BG, 43BB of the light distribution pattern forming unit 41B, and the light distribution pattern of light emitted from the diffraction gratings 43CR, 43CG, 43CB of the light distribution pattern forming unit 41C are different from each other.

Information input to the input unit 61 of the present embodiment includes information of the selection of a predetermined image to be drawn that has been described in the fourth embodiment, intensity of each piece of the laser light of different wavelengths emitted from the light source 30, and the emission time length of the laser light. Examples of the input unit 61 of the present embodiment include a switch group in which a plurality of rotary switches are mounted on a circuit board.

Next, light emission by the vehicle lamp 1 of the present embodiment will be described.

The above-mentioned control unit 60 detects, for example, a signal indicating the image drawing from the vehicle control device 54, and, in the case of the input state where the signal indicating the image drawing is input to the control unit 60, the above-mentioned control unit 60 controls the emission state of the laser light of the light source 30 and the rotation state of the output shaft 52 of the motor 50 to cause the vehicle lamp 1 to emit light.

Specifically, the control unit 60 drives the motor driver 51 on the basis of the signal input from the encoder 53 to the control unit 60 and the signal input from the input unit 61 to the control unit 60, rotates the diffraction grating unit 40 to a position where the any of the diffraction gratings of the light distribution pattern forming unit corresponding to the image selected by the user in the input unit 61 overlaps the entire region 31, and causes the light source 30 to emit the laser light of a color corresponding to the diffraction grating that is overlapping the entire region 31 for a predetermined time. For example, when the image shown in FIG. 8A is selected in the input unit 61, the control unit 60 rotates the diffraction grating unit 40 to the position where the diffraction grating 43AR corresponding to the red laser light of the light distribution pattern forming unit 41A overlaps the entire region 31. Next, the control unit 60 drives the drive circuit of the light source 30 to cause the light source 30 to emit red laser light for a predetermined time in a state where the diffraction grating 43AR overlaps the entire region 31. The red laser light emitted from the light source 30 is incident on the diffraction grating 43AR and is diffracted by the diffraction grating 43AR as described above. The red component light of the light distribution pattern in which the image shown in FIG. 8A is drawn is emitted from the diffraction grating 43AR for a predetermined time. The red component light of the light distribution pattern is emitted from the vehicle lamp 1 through the front cover 12 for a predetermined time.

Next, the control unit 60 drives the motor driver 51, rotates the diffraction grating unit 40 to a position where the diffraction grating 43AG corresponding to the green laser light of the light distribution pattern forming unit 41A overlaps the entire region 31, and in a state where the diffraction grating 43AG overlaps the entire region 31, the control unit 60 causes the light source 30 to emit the green laser light for a predetermined time. In the present embodiment, the emission time length of the green laser light is approximately the same as the emission time length of the red laser light described above. The green laser light emitted from the light source 30 is incident on the diffraction grating 43AG and is diffracted by the diffraction grating 43AG as described above. The green component light of the light distribution pattern in which the image shown in FIG. 8A is drawn is emitted from the diffraction grating 43AG for a predetermined time. The green component light of the light distribution pattern is emitted from the vehicle lamp 1 through the front cover 12 for a predetermined time.

Next, the control unit 60 drives the motor driver 51, rotates the diffraction grating unit 40 to a position where the diffraction grating 43AB corresponding to the blue laser light of the light distribution pattern forming unit 41A overlaps the entire region 31, and in a state where the diffraction grating 43AB overlaps the entire region 31, the control unit 60 causes the light source 30 to emit the blue laser light for a predetermined time. In the present embodiment, the emission time length of the blue laser light is approximately the same as the emission time length of the red laser light described above. The blue laser light emitted from the light source 30 is incident on the diffraction grating 43AB and is diffracted by the diffraction grating 43B as described above. The blue component light of the light distribution pattern in which the image shown in FIG. 8A is drawn is emitted from the diffraction grating 43AB for a predetermined time. The blue component light of the light distribution pattern is emitted from the vehicle lamp 1 through the front cover 12 for a predetermined time.

The control unit 60 controls the emission state of the laser light of the light source 30 and the rotation state of the output shaft 52 of the motor 50 so that rotation of the diffraction grating unit 40, emission of the red laser light from the light source 30, rotation of the diffraction grating unit 40, emission of the green laser light from the light source 30, rotation of the diffraction grating unit 40, emission of the blue laser light from the light source 30 are sequentially repeated. That is, the emission of the red laser light, the green laser light, and the blue laser light of the light source 30 in a time division manner and the rotation of the diffraction grating unit 40 are synchronized with each other. The red component light of the light distribution pattern in which the image shown in FIG. 8A is drawn, the green component light of the light distribution pattern in which the image is drawn, and the blue component light of the light distribution pattern in which the image is drawn are sequentially and repeatedly emitted from the vehicle lamp 1. In the present embodiment, since the emission time lengths of the red laser light, the green laser light, and the blue laser light are approximately the same, the emission time lengths of the red component light of the light distribution pattern in which the image shown in FIG. 8A is drawn, the green component light of the light distribution pattern in which the image is drawn, and the blue component light of the light distribution pattern in which the image is drawn are also approximately the same.

Note that the rotation direction of the diffraction grating unit 40 is not particularly limited. The rotation direction of the diffraction grating unit 40 may be one direction, and may be changed according to the color of the laser light emitted from the light source 30. That is, one direction of a direction at the time of rotating to a position where the diffraction grating 43AR corresponding to the red laser light overlaps the entire region 31, a direction at the time of rotating to a position where the diffraction grating 43AG corresponding to the green laser light overlaps the entire region 31, and a direction at the time of rotating to a position where the diffraction grating 43AG corresponding to the blue laser light overlaps the entire region 31 may be different from the other two directions. Furthermore, the control unit 60 may control the emission state of the laser light of the light source 30 and the rotation state of the output shaft 52 of the motor 50 so that the laser light is incident on the diffraction grating that is rotating.

As mentioned above, when pieces of light of different colors are repeatedly applied in a cycle shorter than the time resolution of human vision, a human may recognize that light obtained by synthesizing the pieces of light of different colors is applied by the afterimage phenomenon. In the present embodiment, when the time from emitting the laser light of a predetermined color to emitting the laser light of the predetermined color again is shorter than the time resolution of human vision, the light emitted from the diffraction gratings 43AR, 43AG, 43AB are repeatedly applied in a shorter cycle than the time resolution of human vision, and the red light, the green light, and the blue light are synthesized by the afterimage phenomenon. The emission time lengths of the pieces of light are approximately the same. Furthermore, as described above, the intensity of laser light is adjusted so that the color of the light obtained by synthesizing the pieces of laser light is white in the initial state. Therefore, the color of the light obtained by synthesizing by the afterimage phenomenon is white. At this time, the light distribution pattern of the red light, the green light, and the blue light is equivalent to the light distribution pattern in which the image shown in FIG. 8A is drawn as described above. The intensity distribution of the light distribution pattern of the red light, green light, and blue light is made to be an intensity distribution based on the intensity distribution of the light distribution pattern in which the image is drawn. Therefore, the light distribution pattern of the light obtained by synthesizing the red light, the green light, and the blue light by the afterimage phenomenon is the light distribution pattern in which the image shown in FIG. 8A is drawn. Note that the cycle of repeatedly emitting the red laser light, the green laser light, and the blue laser light is preferably 1/15 s or less as mentioned above from the viewpoint of suppressing feeling of the flicker of light obtained by synthesizing the afterimage phenomenon, and more preferably 1/30 s or less, still more preferably 1/60 s or less.

Note that, it is preferable that the diffraction gratings 43AR, 43AG, 43AB diffract incident laser light and emit light so that at least some of the outer shapes of the regions irradiated by the light emitted from these diffraction gratings match with each other, and it is more preferable that the diffraction gratings 43AR, 43AG, 43AB diffract incident laser light and emit light so that the entire outer shapes match each other. With such a configuration, it is possible to suppress the occurrence of color bleeding near the edges of the light distribution pattern formed by the afterimage phenomenon as described above.

In this way, the vehicle lamp 1 can draw the image shown in FIG. 8A on the road surface or the like with white light by the afterimage phenomenon of light. Note that by changing the light distribution pattern forming unit on which the light emitted from the light source 30 is incident, the image drawn on the road surface or the like can be switched. In order to switch the image to be drawn on the road surface or the like, as similar to the case in which the control unit 60 controls the emission state of the laser light of the light source 30 and the rotation state of the output shaft 52 of the motor 50 to draw the image shown in FIG. 8A described above on a road surface or the like, it is sufficient that the control unit 60 causes incidence of the laser light from the light source 30 to the diffraction gratings 43BR, 43BG, 43BB of the light distribution pattern forming unit 41B and the diffraction gratings 43CR, 43CG, 43CB of the light distribution pattern forming unit 41C. The description thereof is omitted.

Furthermore, as described above, the input unit 61 is electrically connected to the control unit 60, the intensity of each piece of the laser light emitted from the light source 30 and the emission time length of each piece of the laser light are input to the control unit 60 from the input unit 61 by electric signals, along with the information of selection of the predetermined image to be drawn.

In the present embodiment, the intensity of each piece of the laser light emitted from the light source 30 and the emission time length of each piece of the laser light can be adjusted by the input unit 61. Therefore, the color balance of the image to be drawn can be adjusted in a similar manner to that in the first embodiment.

By the way, since the diffraction gratings 43AR, 43AG, 43AB, 43BR, 43BG, 43BB, 43CR, 43CG, 43CB have wavelength dependence, pieces of light having different wavelengths tend to have different light distribution patterns due to the diffraction gratings. In the vehicle lamp of the present embodiment, as described above, the light distribution pattern forming units 41A, 41B, 41C include each one from sets of the diffraction gratings 43AR, 43BR, 43CR corresponding to the red laser light, the diffraction gratings 43AG, 43BG, 43CG corresponding to the green laser light, and the diffraction gratings 43AB, 43BB, 43CB corresponding to the blue laser light. In the light distribution pattern forming units 41A, 41B, 41C, the red laser light is diffracted by the diffraction gratings 43AR, 43BR, 43CR, the green laser light is diffracted by the diffraction gratings 43AG, 43BG, 43CG, and the blue laser light is diffracted by the diffraction gratings 43AB, 43BB, 43CB. For this reason, in the light distribution pattern forming unit 41A, it is easy to make regions irradiated with pieces of light emitted from the diffraction gratings 43AR, 43AG, 43AB overlap with each other. Furthermore, in the light distribution pattern forming unit 41B, it is easy to make regions irradiated with pieces of light emitted from the diffraction gratings 43BR, 43BG, 43BB, respectively, overlap with each other. Furthermore, in the light distribution pattern forming unit 41C, it is easy to make regions irradiated with pieces of light emitted from the diffraction gratings 43CR, 43CG, 43CB, respectively, overlap with each other. Therefore, it is easy to draw an image corresponding to these light distribution pattern forming units by the afterimage phenomenon.

Furthermore, the light source 30 of the present embodiment emits the red laser light, the green laser light, and the blue laser light having different wavelengths. Therefore, by adjusting the intensity of each piece of laser light emitted from the light source 30, light of a desired color can be applied by the afterimage phenomenon, and an image of a desired color can be drawn on the road surface or the like.

Furthermore, in the present embodiment, the diffraction gratings 43AR, 43AG, 43AB, 43BR, 43BG, 43BB, 43CR, 43CG, 43CB are arranged on the circumference of the circle C centering on the rotation axis 52A of the output shaft 52 which is the rotation axis of the support member 42. Therefore, by rotating the support member 42 by a predetermined angle, it is possible to switch the diffraction grating on which the light emitted from the light source 30 is incident, and thus the image to be drawn on the road surface or the like can be switched by switching the light distribution pattern forming unit that emits light. Therefore, as compared with the vehicle lamp that adjusts the irradiation angle of the light emitted from the light source to draw an image on the road surface as described above, the image can be drawn on the road surface or the like with a simpler configuration. Furthermore, a moving image can be drawn on a road surface or the like by continuously rotating the support member 42 and continuously switching the images. Furthermore, it is possible to suppress the operating noise when switching the image drawn on the road surface or the like, as compared with the case of switching the image drawn on the road surface or the like by reciprocating the support member.

Sixth Embodiment

Next, a sixth embodiment of the present invention will be described in detail with reference to FIG. 10. Note that the same or equivalent constituent elements as those of the fifth embodiment are denoted by the same reference numerals, and redundant explanation will be omitted except when particularly described.

Figure 10:
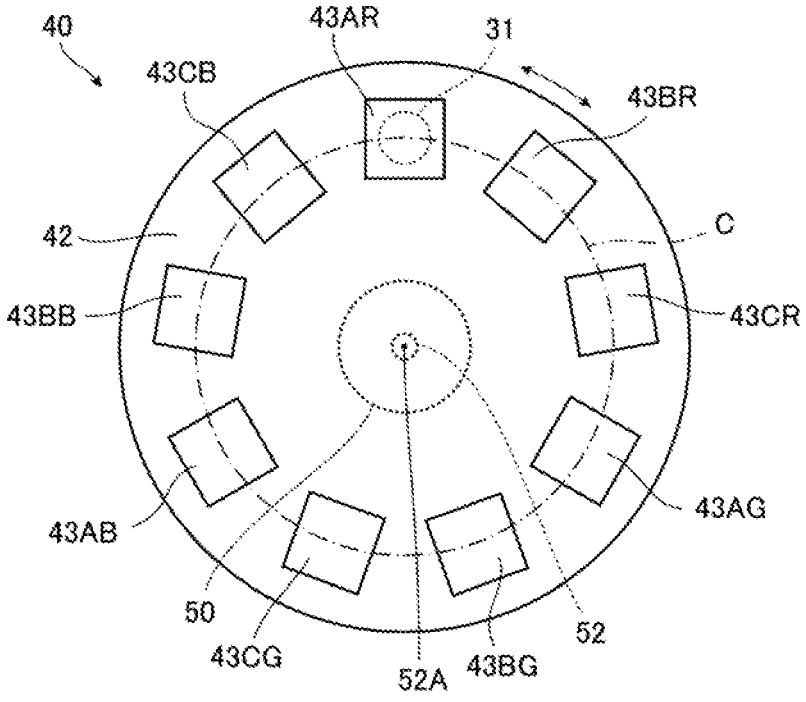
FIG. 10 is a front view schematically showing a diffraction grating unit of a vehicle lamp according to a sixth embodiment of the present invention.

FIG. 10 is a front view schematically showing a diffraction grating unit of a vehicle lamp according to the present embodiment. As shown in FIG. 10, the diffraction grating unit of the present embodiment is different from the diffraction grating unit 40 in the fifth embodiment in points that the arrangement of the plurality of diffraction gratings included in the plurality of light distribution pattern forming units is different. The diffraction grating unit 40 of the present embodiment includes three light distribution pattern forming units 41A, 41B, 41C and the support member 42 as main components, and the laser light emitted from the light source 30 is incident on the diffraction grating unit 40. In the present embodiment, the light distribution pattern forming unit 41A includes three diffraction gratings 43AR, 43AG, 43AB, the light distribution pattern forming unit 41B includes three diffraction gratings 43BR, 43BG, 43BB, and the light distribution pattern forming unit 41C includes three diffraction gratings 43CR, 43CG, 43CB. Note that, in FIG. 10, the reference numerals of the light distribution pattern forming units are omitted for easy understanding.

In the present embodiment, although the diffraction gratings 43AR, 43AG, 43AB, 43BR, 43BG, 43BB, 43CR, 43CG, 43CB are arranged on the circumference of the circle C centering on the rotation axis 52A as viewed from the direction of the rotation axis 52A of the output shaft of the motor as similar to the diffraction gratings of the fifth embodiment, the order of arrangement of these diffraction gratings in the circumferential direction of the circle C is different from that of the fifth embodiment. Specifically, these diffraction gratings are not arranged side by side for each of the light distribution patternf forming units 41A, 41B, 41C in the circumferential direction of the circle C. In the circumferential direction of the circle C, the diffraction grating 43BR of the light distribution pattern forming unit 41B and the diffraction grating 43CR of the light distribution pattern forming unit 41C are located between the diffraction grating 43AR and the diffraction grating 43AG of the light distribution pattern forming unit 41A. Furthermore, the diffraction grating 43BG of the light distribution pattern forming unit 41B and the diffraction grating 43CG of the light distribution pattern forming unit 41C are located between the diffraction grating 43AG and the diffraction grating 43AB of the light distribution pattern forming unit 41A. Furthermore, the diffraction grating 43BB of the light distribution pattern forming unit 41B and the diffraction grating 43CB of the light distribution pattern forming unit 41C are located between the diffraction grating 43AB and the diffraction grating 43AR of the light distribution pattern forming unit 41A. The three diffraction gratings 43AR, 43AG, 43AB of the light distribution pattern forming unit 41A are arranged at approximately equal intervals along the entire circumference of the circle C and are arranged so as to be rotationally symmetric with respect to the rotation axis 52A. Furthermore, the three diffraction gratings 43BR, 43BG, 43BB of the light distribution pattern forming unit 41B are arranged at approximately equal intervals in the entire circumference of the circle C in a similar manner to the three diffraction gratings 43AR, 43AG, 43AB of the light distribution pattern forming unit 41A, and are arranged so as to be rotationally symmetric with respect to the rotation axis 52A. Furthermore, the three diffraction gratings 43CR, 43CG, 43CB of the light distribution pattern forming unit 41C are arranged at approximately equal intervals in the entire circumference of the circle C in a similar manner to the three diffraction gratings 43AR, 43AG, 43AB of the light distribution pattern forming unit 41A, and are arranged so as to be rotationally symmetric with respect to the rotation axis 52A.

With this configuration, the diffraction grating overlapping the region on which the laser light emitted from the light source is incident in each light distribution pattern forming unit can be sequentially changed by sequentially rotating the support member 42 by a predetermined angle. Therefore, even when the rotation speed of the support member 42 is set constant, the irradiation intervals of the red light, the green light, and the blue light described in the fifth embodiment can be set constant. Therefore, it is possible to suppress feeling of the flicker of light obtained by synthesizing by the afterimage phenomenon. Furthermore, in each light distribution pattern forming unit, as compared to the case where a plurality of diffraction gratings are not arranged at approximately equal intervals on the entire circumference, the control of the rotation state of the output shaft 52 of the motor 50 by the control unit 60 can be simplified, and synchronization of emission of the plurality of pieces of laser light in a time division manner, and the rotation of the support member 42 can be facilitated.

Note that, in the fourth, fifth, and sixth embodiments, the vehicle lamp 1 for drawing an image of a mark similar to an arrow or a parking prohibition sign has been described as an example, but an image and the number of images drawn by the vehicle lamp are not particularly limited.

Furthermore, in the fourth embodiment described above, the light distribution pattern of light emitted from the diffraction grating 43A of the light distribution pattern forming unit 41A, the light distribution pattern of light emitted from the diffraction grating 43B of the light distribution pattern forming unit 41B, the light distribution pattern of light emitted from the diffraction grating 43C of the light distribution pattern forming unit 41C, and the light distribution pattern of light emitted from the diffraction grating 43D of the light distribution pattern forming unit 41D are different from each other. In the fifth and sixth embodiments, the light distribution pattern of light emitted from the diffraction gratings 43AR, 43AG, 43AB of the light distribution pattern forming unit 41A, the light distribution pattern of light emitted from the diffraction gratings 43BR, 43BG, 43BB of the light distribution pattern forming unit 41B, and the light distribution pattern of light emitted from the diffraction gratings 43CR, 43CG, 43CB of the light distribution pattern forming unit 41C are different from each other. However, in the fourth, fifth, and sixth embodiments, it is sufficient that the light distribution patterns of the light emitted from the diffraction gratings of at least two light distribution pattern forming units are different from each other. For example, the diffraction grating unit may include a plurality of the same light distribution pattern forming units. Furthermore, it is sufficient that the light distribution pattern forming unit may include at least one diffraction grating that emits light having a predetermined light distribution pattern. For example, even if the light source is a vehicle lamp that does not emit light in a time division manner as in the fourth embodiment, the light distribution pattern forming unit may include a plurality of diffraction gratings that emit light of a predetermined light distribution pattern. Even if configured in this manner, for example, by making pieces of light from a light source incident on these diffraction gratings at the same time, it is possible to irradiate an irradiation target object such as a road surface with the emitted pieces of light such that the pieces of light overlap each other, and a predetermined image can be drawn.

Furthermore, in the fourth embodiment, the light source 30 having three light emitting elements and capable of emitting laser light of a desired color has been described as an example. However, in the vehicle lamp in which the light source does not emit light in a time division manner as in the fourth embodiment, it is sufficient that the light source can emit laser light. For example, the light source may have one light emitting element.

Furthermore, in the fifth embodiment, the light source 30 that emits three pieces of laser light having different wavelengths in a time division manner has been described as an example. However, in the fifth and sixth embodiments, in the vehicle lamp in which the light source emits a plurality of pieces of laser light having different wavelengths in a time division manner, for example, the light source may be a light source that emits two pieces of laser light having different wavelengths in a time division manner, or may be a light source that emits three or more pieces of laser light having different wavelengths in a time division manner.

Furthermore, in the fourth embodiment, the control unit 60 in which the information for selecting the predetermined image to be drawn is input from the input unit 61 has been described as an example. Furthermore, in the fifth embodiment, the control unit 60 has been described as an example, in which intensity of a plurality of pieces of laser light having different wavelengths emitted from the light source 30 and the emission time length of the laser light are input from the input unit 61 along with information of selection of a predetermined image to be drawn. However, in the fourth, fifth, and sixth embodiments, it is sufficient that at least information of selection of a predetermined image to be drawn is input to the control unit 60, and the vehicle lamp may not include the input unit 61. In a case where the vehicle lamp does not include the input unit 61, for example, the control device of the vehicle may output a signal indicating the information of selection of an image on the basis of a signal related to the vehicle state such as a signal related to left and right turn motions and a signal related to back motions, and the signal indicating the information of selection of an image may be input to the control unit from the control device of the vehicle. Moreover, in the vehicle lamp in which the light source emits a plurality of pieces of laser light having different wavelengths in a time division manner as in the fifth and sixth embodiments, the control unit may control the emission state of the laser light from the light source on the basis of a predetermined set value or the like related to the intensity of the laser light emitted from the light source, the emission time length of the laser light, or the like. In the vehicle lamp having such a configuration, by adjusting this predetermined set value when manufacturing or the like, the intensity of the laser light emitted from the light source and the emission time length of the laser light can be adjusted, and the color balance of the light applied by the afterimage phenomenon can be adjusted. Therefore, the vehicle lamp having such a configuration can switch the image to be drawn and can adjust the color balance.

Furthermore, in the fourth, fifth, and sixth embodiments, the transmissive diffraction gratings 43A, 43B, 43C, 43D, 43AR, 43AG, 43AB, 43BR, 43BG, 43BB, 43CR, 43CG, 43CB are described as an example. However, the diffraction grating may be a reflection type diffraction grating. Furthermore, in the fourth embodiment, the support member 42 having the circular outer shape of the front view and the diffraction gratings 43A, 43B, 43C, 43D having an outer shape of the approximately fan shape of the front view are described as an example. However, these outer shapes are not particularly limited. Furthermore, in the fifth and sixth embodiments, the support member 42 having the circular outer shape of the front view and the diffraction gratings 43AR, 43AG, 43AB, 43BR,43BG,43BB,43CR,43CG,43CB having a quadrangular outer shape of the front view are described as an example. However, these outer shapes are not particularly limited.

In the fourth, fifth, and sixth embodiments described above, the diffraction gratings 43A, 43B, 43C, 43D, 43AR, 43AG, 43AB, 43BR, 43BG, 43BB, 43CR, 43CG, 43CB have the same diffraction grating pattern (not shown) in each of grating regions (not shown) formed by being divided in the radial direction and the circumferential direction of the circle C centering on the rotation axis of the support member 42. However, the direction of division for forming the grating region of the diffraction grating is not particularly limited.

Furthermore, in the fourth, fifth, and sixth embodiments, the diffraction grating unit 40 including the support member and the plurality of diffraction gratings has been described as an example. However, the diffraction grating unit does not have to include a support member, and for example, the diffraction grating unit 40 may be formed by integrating a plurality of diffraction gratings and a support member with each other. In such a case, a part of these diffraction gratings may also serve as a support member.

Furthermore, in the fifth and sixth embodiments described above, the light distribution pattern forming units 41A, 41B, 41C that include each one from sets of the diffraction gratings 43AR, 43BR, 43CR corresponding to the red laser light, the diffraction gratings 43AG, 43BG, 43CG corresponding to the green laser light, and the diffraction gratings 43AB, 43BB, 43CB corresponding to the blue laser light, has been described as an example. However, in the vehicle lamp in which the light source emits a plurality of pieces of laser light having different wavelengths in a time division manner as in the fifth and sixth embodiments, the light distribution pattern forming unit may include a plurality of sets including a plurality of diffraction gratings corresponding to the laser light of respective wavelengths emitted from the light source.

As described above, according to the present invention, there is provided a vehicle lamp that can adjust color balance, and can draw an image on a road surface or the like and can switch the image to be drawn with a simple structure, and the present invention can be used in the field of vehicle lamps of an automobile or the like.

REFERENCE SIGNS LIST

1 . . . vehicle lamp
10 . . . housing
20 . . . lamp unit
30 . . . light source
40 . . . diffraction grating unit
41A, 41B, 41C, 41D . . . light distribution pattern forming unit
42 . . . support member
43R, 43G, 43B, 43A, 43C, 43D, 43AR, 43AG, 43AB, 43BR, 43BG,
43BB, 43CR, 43CG, 43CB . . . diffraction grating
50 . . . motor
52 . . . output shaft
52A . . . rotation axis
53 . . . encoder
55 . . . optical path changing element
60 . . . control unit
C . . . circle
L1 . . . straight line

The invention claimed is:

1. A vehicle lamp comprising:

a light source that repeatedly emits a plurality of pieces of laser light having different wavelengths one by one in order; and a plurality of diffraction gratings that correspond to the pieces of laser light of wavelengths, respectively, a support member that supports the plurality of diffraction gratings and rotates, wherein the pieces of laser light of the wavelengths emitted from the light source are incident on the diffraction gratings corresponding to the pieces of laser light, respectively, and regions irradiated with pieces of light emitted from the diffraction gratings overlap with each other;

wherein the plurality of diffraction gratings are arranged in a circumferential direction on a circumference of a circle centering on a rotation axis of the support member, wherein the plurality of diffraction gratings are arranged in the circumferential direction in an order corresponding to the order in which the plurality of pieces of laser light are emitted from the light source, and wherein emission of the plurality of the pieces of laser light in the one by one order and rotation of the support member are synchronized with each other.

2. The vehicle lamp according to claim 1, wherein at least some of outer shapes of the regions irradiated with the pieces of light emitted from the diffraction gratings match.

3. The vehicle lamp according to claim 1, wherein the light source emits at least three pieces of the laser light having different wavelengths.

4. A vehicle lamp comprising:

a light source that repeatedly emits a plurality of pieces of laser light having different wavelengths one by one in order; and a plurality of diffraction gratings that correspond to the pieces of laser light of wavelengths, respectively, and an optical path changing element for guiding the pieces of laser light of the wavelengths emitted from the light source to the diffraction gratings corresponding to the pieces of laser light, wherein the pieces of laser light of the wavelengths emitted from the light source are incident on the diffraction gratings corresponding to the pieces of laser light, respectively, and regions irradiated with pieces of light emitted from the diffraction gratings overlap with each other, and wherein the plurality of pieces of laser light are incident on the optical path changing element one by one in the order of being emitted from the light source, and each laser light is guided to the diffraction gratings corresponding to each laser light by the optical path changing element.

5. A vehicle lamp comprising:

a light source repeatedly emits the plurality of pieces of laser light having different wavelengths one by one in order;

a plurality of light distribution pattern forming units; and a support member that supports the plurality of light distribution pattern forming units and rotates, wherein emission of the plurality of pieces of laser light one by one in order and rotation of the support member are synchronized with each other, wherein each of the light distribution pattern forming units includes at least one diffraction grating that is arranged on a circumference of a circle centering on a rotation axis of the support member, and emits light of a predetermined light distribution pattern upon incidence of laser light emitted from the light source, wherein light distribution patterns of the light emitted from the diffraction gratings of at least two of the light distribution pattern forming units are different from each other, wherein the plurality of diffraction gratings are arranged in the circumferential direction in an order corresponding to the order in which the plurality of pieces of laser light are emitted from the light source, wherein each of the light distribution pattern forming units includes at least one set including the plurality of diffraction gratings corresponding to the pieces of laser light of the wavelengths, and wherein in each of the light distribution pattern forming units, the pieces of laser light of the wavelengths emitted from the light source are incident on the diffraction gratings corresponding to the pieces of laser light.

6. The vehicle lamp according to claim 5, wherein at least some of outer shapes of regions irradiated with the pieces of light emitted from the plurality of diffraction gratings match.

7. The vehicle lamp according to claim 5, wherein the light source emits at least three pieces of the laser light having different wavelengths.

* * * * *